US007603065B2

(12) United States Patent
Yamaguchi et al.

(10) Patent No.: US 7,603,065 B2
(45) Date of Patent: Oct. 13, 2009

(54) IMAGE FORMING APPARATUS, CARTRIDGE, STORAGE DEVICE AND DEVELOPER SUPPLYING METHOD

(75) Inventors: Seiji Yamaguchi, Mishima (JP); Issei Imamura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 485 days.

(21) Appl. No.: 11/431,967

(22) Filed: May 11, 2006

(65) Prior Publication Data

US 2006/0263106 A1 Nov. 23, 2006

(30) Foreign Application Priority Data

May 19, 2005 (JP) ..... 2005-146448
May 19, 2005 (JP) ..... 2005-146476

(51) Int. Cl.
*G03G 15/08* (2006.01)

(52) U.S. Cl. ..... 399/258; 399/255

(58) Field of Classification Search ..... 399/255, 399/258, 260, 262, 263
See application file for complete search history.

(56) References Cited

U.S. PATENT DOCUMENTS 6,094,547 A * 7/2000 Hart ..... 399/44
2004/0197110 A1* 10/2004 Bessho et al. ..... 399/27
2004/0253006 A1* 12/2004 Hayashi et al. ..... 399/12

FOREIGN PATENT DOCUMENTS

JP 05-088554 A 4/1993
JP 08-146736 A 6/1996

* cited by examiner

*Primary Examiner*—David M Gray
*Assistant Examiner*—Joseph S Wong
(74) *Attorney, Agent, or Firm*—Canon U.S.A., Inc., I.P. Division

(57) ABSTRACT

An image forming apparatus is provided which includes a developing apparatus configured to form a developer image; a supply apparatus configured to supply developer to the developing apparatus; a detector configured to detect an amount of developer consumed during an image forming process; and a controller configured to perform an addition calculation for the amount of developer consumed, and for employing a value obtained by the addition calculation and a supply threshold value to determine whether developer should be supplied to the developing apparatus, wherein the controller sets the supply threshold value in accordance with an operating state of the developing apparatus.

8 Claims, 25 Drawing Sheets

| | 0～12500 | 12500～22500 | 25000～32500 | 32500～40000 |
|---|---|---|---|---|
| LL | 0.8 | 0.8 | 0.8 | 0.7 |
| NN | 0.8 | 0.8 | 0.7 | 0.6 |
| HH | 0.8 | 0.7 | 0.6 | 0.5 |

IMAGE FORMING APPARATUS, CARTRIDGE, STORAGE DEVICE AND DEVELOPER SUPPLYING METHOD

BACKGROUND OF THE INVENTION

1. Field of the Invention

The present invention relates to an image forming apparatus, such as a copier or a page printer, that includes a developing apparatus that employs electro-photography, for example, to form a latent image on an image bearing member, that develops the latent image using a developer transporting member that supplies a developer to develop an image. The present invention also relates to a cartridge, a storage device and a developer supply method.

2. Description of the Related Art

Conventionally, two-component developing apparatuses, which employ a two-component developer containing toner and a carrier, have been employed for image forming apparatuses. Recently, however, there has been increased use of one-component developing apparatuses, which employ developers, such as magnetic toner, having a single component and a simple composition. In addition, from the viewpoint that further improvements are desirable, service life has been extended and running costs have been reduced, and many one-component supply methods for supplying toner for one-component developing systems have been proposed.

Since a large amount of toner is contained in a developer container for a one-component supply system, this system is advantageous, in that a precise toner supply control process, such as that provided for a two-component supply system, is not required.

For a developing apparatus that employs this supply type, toner to be consumed for image forming is supplied, by a toner supply device, in order to maintain a constant toner level in the developer container. To accomplish this, one method has been proposed whereby a valve, provided in a developer container, mechanically maintains the toner level and another method has been proposed whereby a sensor, which also is provided in the developer container, detects the toner level and toner is supplied based on the detection results.

Furthermore, as described, for example, in Japanese Patent Laid-Open No. Hei 5-88554 or No. Hei 8-146736, a toner supply method that employs a video count value has been practically employed. According to this method, output signal levels for all pixels in a digital image are added together and a printing ratio is obtained for the image, and from this, the amount of toner consumed is calculated to determine how much toner is required to replenish the container.

FIG. 18 is a schematic diagram showing a configuration of a conventional image forming apparatus. In this example, a drum shaped, electrophotographic photosensitive member (hereinafter referred to as a "photosensitive drum") 51, which serves as an image bearing member, is supported almost in the center of an image forming apparatus 100 and is rotated in the direction indicated by an arrow. When an image forming operation is initiated, an electrifier 52 uniformly charges the surface of the photosensitive drum 51, following which a laser irradiation unit 53, which serves as an exposing apparatus, exposes the surface of the photosensitive drum 51, in consonance with image data, and forms an electrostatic latent image thereon.

The electrostatic latent image is then developed by a developing apparatus 4, and a toner image is obtained. Then, a transferring field that is formed between the photosensitive drum 51 and a transferring roller 56 that serves as a transferring unit, the toner image is electrostatically transferred to a recording material P by a transferring roller 56. Thereafter, a fixing apparatus 58 employs heat and pressure to permanently fix the toner image to the recording material P.

Further, after the transfer of the toner image has been completed, residual toner on the surface of the photosensitive drum 51 is removed by a cleaning apparatus 57, for which a blade shaped cleaning member is provided, and the photosensitive drum 51 is thus prepared for the performance of the following image forming process.

The developing apparatus 4 includes a developer container 10, in which developer is contained; a developing roller 11, which is a developer carrier; a supply roller 13, for supplying developer to the developing roller 11; a developer regulation member 14, for controlling the amount of developer deposited on the developing roller 11; and an agitation member 15, for agitating the developer in the developer container 10. A developer supply apparatus 5 is provided above the developer container 10, and as the quantity of toner available in the developer container 10 is reduced, toner from the supply apparatus 5 is supplied, as necessary, to ensure the supply of toner available in the developer container 10 remains constant.

A toner supply method employing the video count measurement will now be explained while referring to FIGS. 15, 16 and 17. FIG. 15 is a block diagram showing the configuration of an apparatus for obtaining a video count. FIGS. 16A to 16D are explanatory diagrams for describing the process by which a video count is obtained. And FIG. 17 is a flowchart for explaining a toner supply operation.

For the image forming apparatus in FIG. 18, the exposing apparatus 53 is a laser scanner that includes a semiconductor laser, a polygon mirror and a lens (none of them shown). A laser beam is emitted by the semiconductor laser, passes though a lens, such as a f/θ lens, and is directed towards the photosensitive drum 51, as a spot, by a fixed mirror and is swept across the photosensitive drum 51, which is an image bearing member, by the polygon mirror. Thus, the laser beam scans the photosensitive drum 51 in a direction substantially parallel to the rotary shaft of the photosensitive drum 51, i.e., in the main scanning direction, and forms an electrostatic latent image.

While referring to FIG. 15, an image that will become an electrostatic latent image is transmitted by a PC, or an image scanner, via an image signal processing circuit 31, to a pulse width modulation circuit 32. Then, for each input pixel image signal, a laser drive pulse having a width consonant with the signal pulse (a time length) is formed and is output to the exposing apparatus 53. That is, as shown in FIG. 16A, for a pixel image signal having a high density, a drive pulse W having a wide width is formed; for a pixel image signal having a low density, a drive pulse S having a narrow width is formed; and for a pixel image signal having a middle density, a drive pulse I having an intermediate width is formed.

The laser drive pulse output by the pulse width modulation circuit 32 is transmitted to the exposing apparatus 53, which then emits a semiconductor laser during a period equivalent to the pulse width. Therefore, the semiconductor laser is emitted for a long period of time for a high density pixel, or for a short period of time for a low density pixel. Thus, for the high density pixel, the photosensitive drum 51 is exposed in the main scanning direction over the long range, and for the low density pixel, it is exposed over the short range. That is, the dot sizes of the electrostatic latent image differ depending on the densities of the pixels. Accordingly, the amount of toner consumed by a high density pixel is larger than is that consumed by a low density pixel. It is noted that L, M and H in FIG. 16B denote low, middle and high density pixels for an electrostatic latent image.

A signal output by the pulse width modulation circuit 32 is transmitted to one of the input terminals of an AND gate 34, and a clock pulse (a pulse shown in FIG. 16C) is transmitted by a clock pulse oscillator 35 to the other input terminal of the AND gate 34. Therefore, as shown in FIG. 16A, the AND gate 34 outputs a count of clock pulses in consonance with the pulse widths of the individual laser drive pulses S, I and W, i.e., the number of clock pulses consonant with the densities of individual pixels. For each image, the clock pulses are totaled by a counter 36, and the result is transmitted to a CPU 37 to obtain a video count. The video count, i.e., the exposure area is then employed to calculate an image printing ratio (an exposure area/paper area). Since the amount of toner to be consumed for image forming has a substantially linear relationship with the image printing ratio, the amount of toner that was probably consumed is predicted based on the image printing ratio, and a supply driver 38 is operated for the time required to replenish the container with toner.

The conventional toner supply operation performed by the image forming apparatus 100 will now be described while referring to FIG. 17. When a main body 100A of the image forming apparatus 100 is powered on (S1) and a predetermined activation process is completed, the image forming apparatus 100 becomes in the standby state (S2). When a print signal is received in the standby state, a printing operation is started (S3), and the photosensitive drum 51, the electrifier 52 and the developing apparatus 4 are sequentially activated (S4). When these apparatuses are about to time to be ready, the exposing apparatus is started to form a latent image, and at the same time, acquisition of video (pixel) count data is started. When the latent image has been formed, the exposing apparatus is halted, and video count totaling is also ended, to obtain a video count total (S5 to S7).

For image forming process, the CPU 37 that controls the operation of the image forming apparatus 100, employs a video count to calculate the amount of toner consumed, i.e., the amount of toner that must be added, and replenishes the toner (S8 and S9).

Thereafter, a check is performed to determine whether the job has been completed (S10). When the job has not yet been completed, and sequential printing is still required, the image forming apparatus 100 returns to step S5 and enters the next image forming cycle to activate the exposing apparatus 53. When there are no sheets remaining for the printing job, the individual apparatuses are halted in order, and the image forming operation is terminated (S10). The image forming apparatus 100 and then returns to step S2, and is set to the standby state.

FIG. 12 is a graph showing the relationship between the image printing ratio and the amount of consumed toner. That is, the image printing ratio and the amount of toner consumed are substantially proportional. In order to maintain a constant volume of toner in the developer container, the amount of toner to be supplied must only be equal to the amount of toner consumed. FIG. 13 is a graph showing the linear relationship between the image printing ratio and the amount of toner to be supplied.

When the above described linear relation is employed, the amount of toner to be supplied can be calculated in accordance with the video count. When the video count is small, the amount of consumed toner is also low, a small amount of toner need only be supplied by driving a toner supply mechanism for a short period of time. When the video count is large, the amount of consumed toner is also large, and a large amount of toner must be supplied by driving the toner supply mechanism for an extended period of time.

With this arrangement, at an appropriate timing, toner can be supplied in consonance with the amount of toner consumed, and a constant amount of toner can be maintained in the developer container. However, there is a case wherein the following problems occur in the above described operation.

Since a large amount of toner is consumed when image forming is performed at a high printing ratio, such as for solid black image printing, accordingly, the amount of supplied toner is increased. When the developer container is replenished with a large amount of new toner, there is no special problem, so long as the charging capability of the developing apparatus is satisfactory. However, in a case wherein the durability of the developing apparatus is lowered and the parts are deteriorated, or wherein the electrostatic property of toner is degraded due to the environment, such as a high temperature and a high humidity, when a large amount of new toner is supplied to the developer container, all the toner can not be fully agitated and charged, so that image fogging or toner scattering will occur.

When, as shown in example 1 in FIG. 14, the relationship between the image printing ratio and the amount of toner supplied is linear, the amount of toner supplied, at a high printing ratio of about 70 to 100%, would exceed the charging capability of the developing apparatus, and image fogging and toner scattering might occur.

Thus, conventionally, the relationship between the image printing ratio and the amount of toner supplied has been reviewed, and a method has been employed whereby, as shown in example 2 in FIG. 14, the inclination of a linear table is set so it is smaller, or as shown in example 3 in FIG. 14, the line indicated for the toner supplied at a high printing ratio is below the line in example 1 for the reduction in the supplied toner amount.

FIGS. 10 and 11 are graphs showing the above described examples 1, 2 and 3 for the shifting of the amount of toner supplied and the amount of toner in the developer container, when the printing of 1000 sheets was performed by changing the printing ratio from 5% to 100% every 100 sheets.

A value (a target value) that the amount of toner in the developer container is aimed at is defined as 150 g. At 130 g, a toner level Low alarm is generated by an optical sensor, and at 170 g, a toner level HI alarm is generated to perform a toner amount restoration sequence.

As understood by referring to Table 1 below, since in Example 1 an amount of toner equivalent to the amount of toner consumed is supplied each time, toner in the developer container is not lowered, as shown in FIG. 11. However, were a large amount of toner supplied during high-ratio printing, image fogging and toner scatting would occur.

TABLE 1

| | Fogging | Developer container toner volume Low |
|---|---|---|
| Example 1 | X | ○ |
| Example 2 | Δ | X |
| Example 3 | Δ | X |

In Examples 2 and 3, since a reduced amount of toner is to be supplied for high-ratio printing, image fogging and toner scatting can be prevented during the high-ratio printing. However, since the amount of toner supplied during high-ratio printing is insufficient, the amount of toner in the developer container is gradually lowered, and either a toner Low alarm for the developer container may be erroneously turned on, or the toner volume restoration sequence may be frequently performed.

As described above, it is very important, but is at the same time difficult, to resolve a problem that arises when toner can not be fully agitated and charged, while a large amount of new toner is being supplied during high-ratio printing, and a request is issued that the amount of toner in a developer container be maintained by accurately adding a required amount.

SUMMARY OF THE INVENTION

One aspect of the present invention is to provide an image forming apparatus that can reduce the number of image failures, while maintaining an appropriate amount of toner in a developer container, and a cartridge and a storage device.

Another aspect of the present invention is to provide an image forming apparatus that can adjust the amount of toner to be supplied, so as to enable the satisfactory agitation and charging of toner, and that can consistently maintain an appropriate amount of developer in a developer container, and a cartridge and a storage device.

According to an exemplary embodiment of the present invention, an image forming apparatus is provided which includes a developing apparatus configured to form a developer image; a supply apparatus configured to supply developer to the developing apparatus; a detector configured to detect an amount of developer consumed during an image forming process; and a controller configured to perform an addition calculation for the amount of developer consumed, and for employing a value obtained by the addition and a supply threshold value to determine whether developer should be supplied to the developing apparatus, wherein the controller sets the supply threshold value in accordance with an operating state of the developing apparatus.

According to another aspect of the present invention, when the value obtained by the addition calculation is greater than the supply threshold value, the supply apparatus replenishes the developing apparatus with an amount of the developer equivalent to the supply threshold value. According to another aspect of the present invention, the image forming apparatus further includes a temperature/humidity detector, wherein the controller employs detection results obtained by the temperature/humidity detector to designate the supply threshold value.

According to yet another aspect of the present invention, the controller sets the supply threshold value in accordance with a workload of the developing apparatus. Moreover, according to another aspect of the present invention, the detector employs a printing ratio to detect the amount of the developer consumed during the image forming process.

According to another exemplary embodiment of the present invention, a detachable cartridge is provided which is configured to be utilized in an image forming apparatus that includes a supply apparatus for supplying developer to a developing apparatus, and a detector for detecting an amount of developer consumed during an image forming process. The cartridge includes a developing apparatus configured to hold developer; and a storage device configured to store information, wherein the storage device includes a first storage area configured to store information related to a value obtained by performing an addition process for the amount of developer consumed; a second storage area configured to store information related to a supply threshold value used for controlling an operation performed by the supply apparatus; and a third storage area configured to store information used to correct the supply threshold value.

According to an aspect of the aforementioned embodiment, the cartridge further includes an image bearing member on which an image is to be formed.

Furthermore, according to another exemplary embodiment of the present invention, a storage device is provided which is adapted to be mounted on a cartridge used in an image forming apparatus that includes a supply apparatus for supplying developer to a developing apparatus, and a detector for detecting an amount of developer consumed during an image forming process. The storage device includes a first storage area configured to store information related to a value obtained through addition performed for the amount of developer consumed; a second storage area configured to store information related to a supply threshold value used to control an operation performed by the supply apparatus; and a third storage area configured to store information for correcting the supply threshold value.

According to yet another embodiment of the present invention, an image forming apparatus is provided which includes a developing apparatus configured to form a developer image; a supply apparatus configured to supply developer to the developing apparatus; a detector configured to detect an amount of developer consumed during an image forming process; and a controller configured to perform addition for the amount of developer consumed, and for, when a value obtained by the addition exceeds that of a supply threshold value, permitting the supply apparatus to replenish the supply of developer, by adding an amount of developer equivalent to that indicated by the supply threshold value, wherein the supply threshold value is smaller than the value of the amount of developer consumed at a maximum printing ratio.

According to an aspect of the present invention, a cartridge that includes at least the developing apparatus is detachable to the image forming apparatus, and wherein a storage device is provided for the cartridge and the value obtained by the addition is stored in the storage device. Also, according to another aspect of the present invention, the supply threshold value is stored in the storage device.

Further features and aspects of the present invention will become apparent from the following description of exemplary embodiments (with reference to the attached drawings).

DESCRIPTION OF THE EMBODIMENTS

Figure 1:
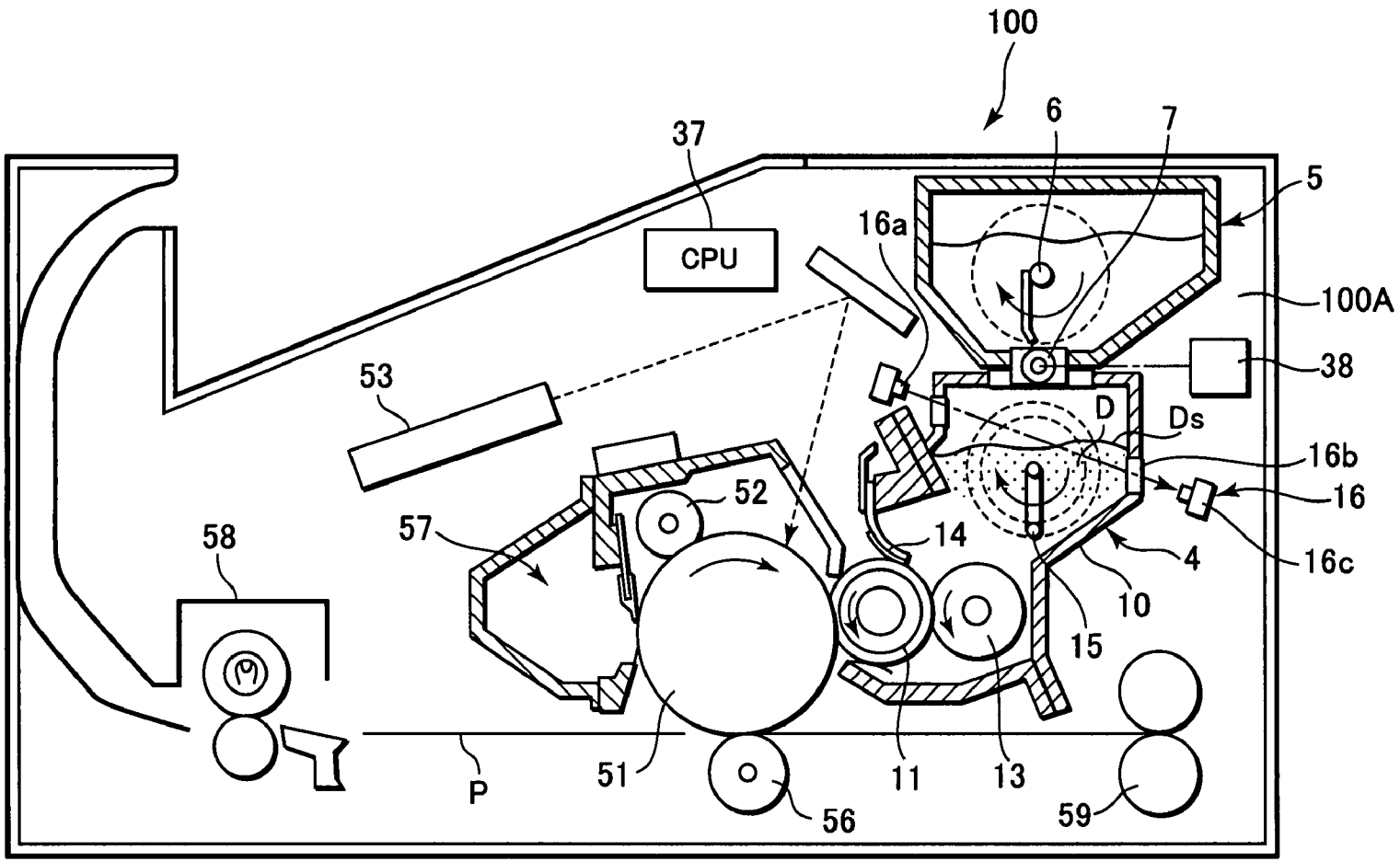
FIG. 1 is a cross-sectional view of an exemplary configuration of an image forming apparatus according to a first embodiment of the present invention.

Numerous embodiments pertaining to an image forming apparatus, a cartridge, a storage device and a developer supplying method according to the present invention will now be described in detail while referring to the drawings.

First Exemplary Embodiment

Figure 18:
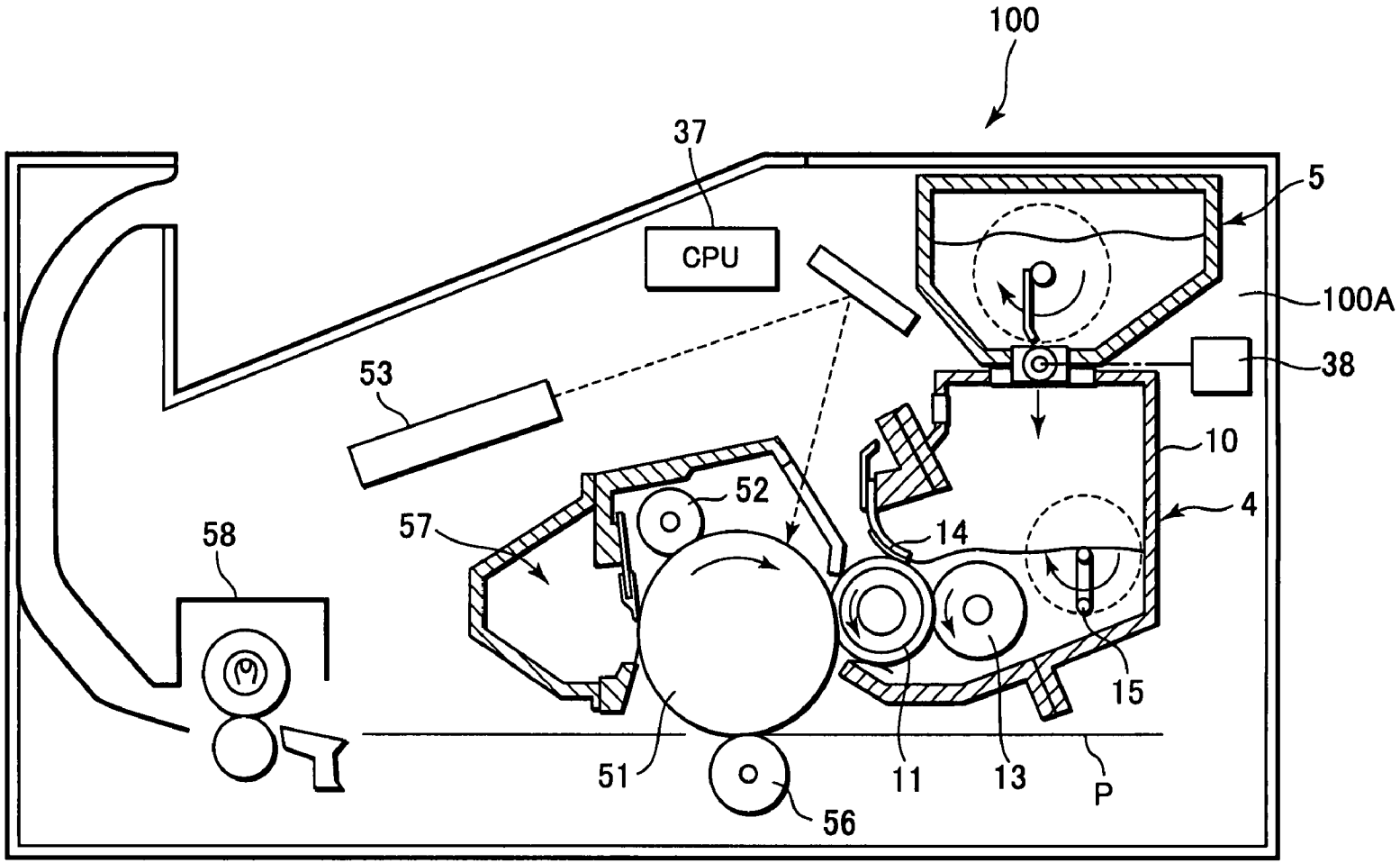
FIG. 18 (PRIOR ART)
FIG. 18 is a cross-sectional view of the configuration of the conventional image forming apparatus.

FIG. 1 is a schematic diagram showing an exemplary arrangement of an image forming apparatus according to a first embodiment of the present invention. Since an image forming apparatus 100 for this embodiment has a similar arrangement as the image forming apparatus 100 previously explained while referring to FIG. 18, the same reference numerals as are used in FIG. 18 are provided for members having the same structures and functions, and previously provided explanations will be quoted while detailed explanations are given for them.

That is, in this embodiment, the image forming apparatus 100 includes a drum shaped electrophotographic photosensitive member, which is an image bearing member that is rotatable in a direction indicated by an arrow, i.e., a photosensitive drum 51. When the image forming operation is started, an electrifier 52 uniformly charges the surface of the photosensitive drum 51, and an exposing apparatus 53, such as a laser irradiation apparatus, performs an exposure in consonance with image information. As a result, an electrostatic latent image is formed on the surface of the photosensitive drum 51. The arrangement for the image signal processing circuit for obtaining a video count is similar to that for the image signal processing circuit of the conventional image forming apparatus explained while referring to FIGS. 15 and 16. Therefore, here, the previous explanation is summarized, for the video count acquisition performed by the image signal processing circuit of this embodiment, so as to avoid a repetition of the previous explanation.

The electrostatic latent image on the photosensitive drum 51 is visualized, by a developing apparatus 4, to obtain a visible image, i.e., a toner image. This toner image is transferred to a recording material P, for example, via a pair roller 59 and then by the transferring roller 56 that serves as a transferring unit. The toner image (unfixed toner image) on the recording material P is permanently fixed to the recording material P by heat and pressure.

After the transferring of the toner image is completed, residual toner on the surface of the photosensitive drum 51 is removed, for example, by a cleaning apparatus 57 that includes a blade shaped cleaning member, and the photosensitive drum 51 is ready for the following image forming process.

The developing apparatus 4 includes a developer container 10, in which a developer D is contained; a developing roller 11, which is a developer carrying member; a supply roller 13, for delivering the developer D to the developing roller 11; a developer regulation member 14, for controlling the amount of developer D on the developing roller 11; and an agitation member 15, for agitating the developer D in the developer container 10. The developer D employed in this embodiment is a non-magnetic, one-component developer having a negative electrostatic property (hereinafter referred to as "toner").

A developer supply apparatus 5 is arranged above the developer container 10. And when toner in the developer container 10 is released and descends, a required amount of replacement toner is supplied, by the supply apparatus 5, so as to constantly maintain, in the developer container 10, a specific amount of toner.

A more detailed explanation, in accordance with the embodiment, will be given for the schematic arrangement of the developing apparatus 4 and its periphery. In this embodiment, an opening is formed in the side of the developer container 10 opposite the photosensitive drum 51. The developing roller 11, which serves as a developer transporting member, is partially exposed through this opening and is supported, by the developer container 10, so that it can rotate in the direction indicated by an arrow, and is held so it contacts, under a predetermined pressure, the photosensitive drum 51. The developing roller 11 is a semi-conductive flexible roller having an external diameter of 16 mm, and is made of a rubber or a porous cellular material, such as silicon or urethane, that is relatively soft and has a volume resistivity of $10^2$ Ωcm to $10^{10}$ Ωcm, and throughout which a conductive agent, such as carbon, is dispersed, or is made of a combination composed of these materials.

The supply roller 13, which serves as developer supply and a collection unit, is a flexible roller, with an external diameter of 16 mm, that is made of sponge, and is located so that it contacts the developing roller 11.

As a developer, agitation and transporting unit, an agitation paddle 15 is arranged at the rear, opposite the opening in the developer container 10, so that it can be rotated in the direction indicated by an arrow. The agitation paddle 15 agitates toner in the developer container 10, and also transports toner to the area near the portion whereat the developing roller 11 contacts the supply roller 13, which will be described later. As the supply roller 13 is rotated, in the direction indicated by the arrow, while in contact with the developing roller 11, friction electrification, associated with the friction between the supply roller 13 and the developing roller 11, occurs and provides a charge for the toner that has been transported. Then, through the application of the mirror force provided by the developing roller 11, the result of the electrostatic charge, the developer for which the charge has been provided is supplied to the developing roller 11.

A blade 14, which serves as a developer thickness regulation member, is provided, for the developer container 10, so that it is pressed against the developing roller 11. The blade 14 is a leaf spring, manufactured by SUS, and is bent so that, within a flexible range, it contacts the developing roller 11 under a predetermined contact pressure. After toner is supplied to the surface of the developing roller 11, the blade 14 controls the thickness of the charged toner and forms a thin toner layer on the developing roller 11, and this toner layer is transported to the developing area.

Toner that is not employed for development and remains on the developing roller 11 is removed from the developing roller 11 by the friction with the supply roller 13, and part of this toner is again supplied to the developing roller 11, by the supply roller 13, with new toner that has been fed to the supply roller 13. The rest of the toner is returned to the developer container 10.

In this embodiment, the supply roller 13 performs at least two functions, including as a developer supply unit and as a collection unit. However, the present invention is not limited to these two functions, and the developer supply unit and the developer collection unit may be separately provided.

The supply apparatus 5, which serves as a developer supply unit, is detachable from a main body 100A of the image forming apparatus 100, and internally retains toner for refilling. Thus, by exchanging the supply apparatus 5 at an appropriate time, toner can be supplied to the image forming apparatus 100.

An agitation member 6, for agitating toner, and a supply roller 7, for refilling toner by transporting it from the supply apparatus 5 to the developing apparatus 4, are provided inside the supply apparatus 5. Further, the supply apparatus 5 receives a refill instruction, from a supply driver 38, to supply a predetermined amount of toner to the developing apparatus 4 for a predetermined period of time.

The processing speed of the image forming apparatus 100 of this embodiment, i.e., the peripheral speed of the photosensitive drum 51, is about 150 mm/sec, while the peripheral speed of the developing roller 11 is 225 mm/sec.

A method based on a video count is employed to provide the toner supply control. However, provisions for directly detecting the amount of toner is also provided inside the developer container 10, in order to avoid a phenomenon whereby, because a calculation performed for toner supply that is based on the video count is not correct, the developer container is filled to overflowing with toner, or because the amount of toner remaining is insufficient and an image can not be output.

In the developer container 10 of the developing apparatus 4, the agitation member 15 is arranged so it can be rotated in the direction indicated by an arrow, and an agitation area is defined wherein toner originally present in the developer container 10 and toner supplied by the supply apparatus 5 are agitated.

Further, optical toner plane detectors 16, for detecting the height of the toner plane in the agitation area, are located outside the developer container 10, and the agitation area in located between them. Each of the toner plane detectors 16 includes a light-emitting device 16*a*, a window 16*b*, through which light is transmitted, and a light-receiving device 16*c*. The toner plane detectors 16 measure the ratio of the light passage time, when a toner plane Ds in the developer container 10 is changed as the agitation member 15 is rotated, and obtain information concerning the height of the toner plane Ds in the agitation area. In this embodiment, an optical detection type is employed as a direct toner plane detector 16; however, a piezosensor type may also be employed.

The toner refill operation performed for this embodiment will now be described in detail. For the toner refill operation according to the embodiment, instead of directly supplying toner in an amount equivalent to that consumed, in accordance with a calculation based on a video count, i.e., the amount of toner to be supplied (t1), the amount (t1) is stored as an addition value (t2) in the storage device (not shown) of the CPU 37, for example, that is the controller provided for the main body 100A. Further, the amount of toner supplied by the toner supply apparatus 5 during one operation is designated as a supply threshold value (t3). When the addition value (t2) for the amount of toner to be supplied exceeds the supply threshold value (t3), the toner supply apparatus 5 performs a single supply operation, and the supply threshold value (t3) is subtracted from the addition value (t2), while for the remainder of the values, addition is continued.

Next, an exemplary toner supply operation will be described while referring to the flowchart in FIG. 2. When the main body 100A of the image forming apparatus 100 is powered ON (S1) and a predetermined activation preparation has been completed, the image forming apparatus enters the standby state (S2). Then, when the image forming apparatus 100, which is in the standby state, receives a print signal, the printing operation is initiated (S3), and components, such as the photosensitive drum 51, the electrifier 52 and the developing apparatus 4, are started sequentially. Then, when the individual apparatuses are almost ready, the exposing apparatus 53 is activated and forms a latent image, while at the same time, the acquisition of video (pixel) count data is begun. Thereafter, when a latent image has been formed, the exposing apparatus 53 is halted and the addition of the video counts is also ended, and the video count value is obtained (S4 to S6).

The CPU 37, which controls the operation of the image forming apparatus 100, employs the video count obtained by each image forming process to calculate the amount of toner consumed, i.e., the amount of toner to be supplied t1, and then calculates a supply addition value t2, which is the sum obtained by adding the amounts of toner to be supplied t1 (S7 and S8).

Following this, the supply addition value t2 is compared with a supply threshold value t3 (S9). When the supply addition value t2≦the supply threshold value t3, the refilling of toner is not performed. But when the supply addition value t2>the supply threshold value t3, an amount of toner equivalent to the supply threshold value t3 is supplied one time, and the supply threshold value t3, the equivalent of the amount supplied, is subtracted from the supply addition value t2 (S10 and S11).

Sequentially, a check is performed to determine whether the job has been completed (S12). When the job has not yet been completed, and there are still sheets to be printed, program control returns to step 4 (S4) and the image forming apparatus enters the next cycle for the activation of the exposing apparatus 53. However, when no more sheets are to be printed, the individual apparatuses are halted sequentially and the image forming operation is terminated (S13). Program control then returns to step S2 (S2), and the image forming apparatus 100 is set to the standby state.

The exemplary operation for this embodiment will be explained more specifically in formula terms. Here, terms may be expressed as follows:

A: the amount of toner carried by the photosensitive drum 51 for development 0.6 mg/cm$^2$ S: the paper size (A4) 21.0*29.7 cm R: the image printing ratio, calculated based on a video count 0 to 100% t1: the amount of toner to be supplied for one sheet (=the amount of toner consumed for one sheet), where t1=A*S*R, and the available range for t1 is 0 to 374 mg t1max: the amount of toner consumed when the maximum printing ratio is R 374 mg t2: the sum of the amounts of toner t3: supply threshold value (=the amount of toner supplied by the toner supply apparatus 5 for one operation)

For this examination, seven standards (100, 150, 200, 250, 300, 350 and 400 mg) can be employed. The amount of toner A carried and the paper size S are numerical values that are corrected, and that depend on the paper size detection and the toner patch density detection performed by the image forming apparatus 100. According to the examination in this embodiment, fixed values are employed in order to reduce influencing factors.

Under the above described conditions, a printing test for 1000 sheets was conducted by changing the printing ratio every 100 sheets, as shown in the Table 2 below, and image fogging, associated with the refilling with toner, and changes in the amount of toner in the developer container were examined.

For this test, 150 g was employed as the target value for the amount of toner in the developer container, and by using an optical sensor, a toner level Low alarm was released at 130 g, and a toner level I alarm was released at 170 g, in order to initiate the sequential toner amount restore process.

TABLE 2

| Sheet count | Printing ratio R (%) | Amount of toner to be supplied for one sheet t1 (mg) |
|---|---|---|
| 0-100 | 5 | 19 |
| 100-200 | 40 | 150 |
| 200-300 | 5 | 19 |
| 300-400 | 70 | 262 |
| 400-500 | 5 | 19 |
| 500-600 | 100 | 374 |
| 600-700 | 5 | 19 |
| 700-800 | 40 | 150 |
| 800-900 | 5 | 19 |
| 900-1000 | 5 | 19 |

Figure 3:
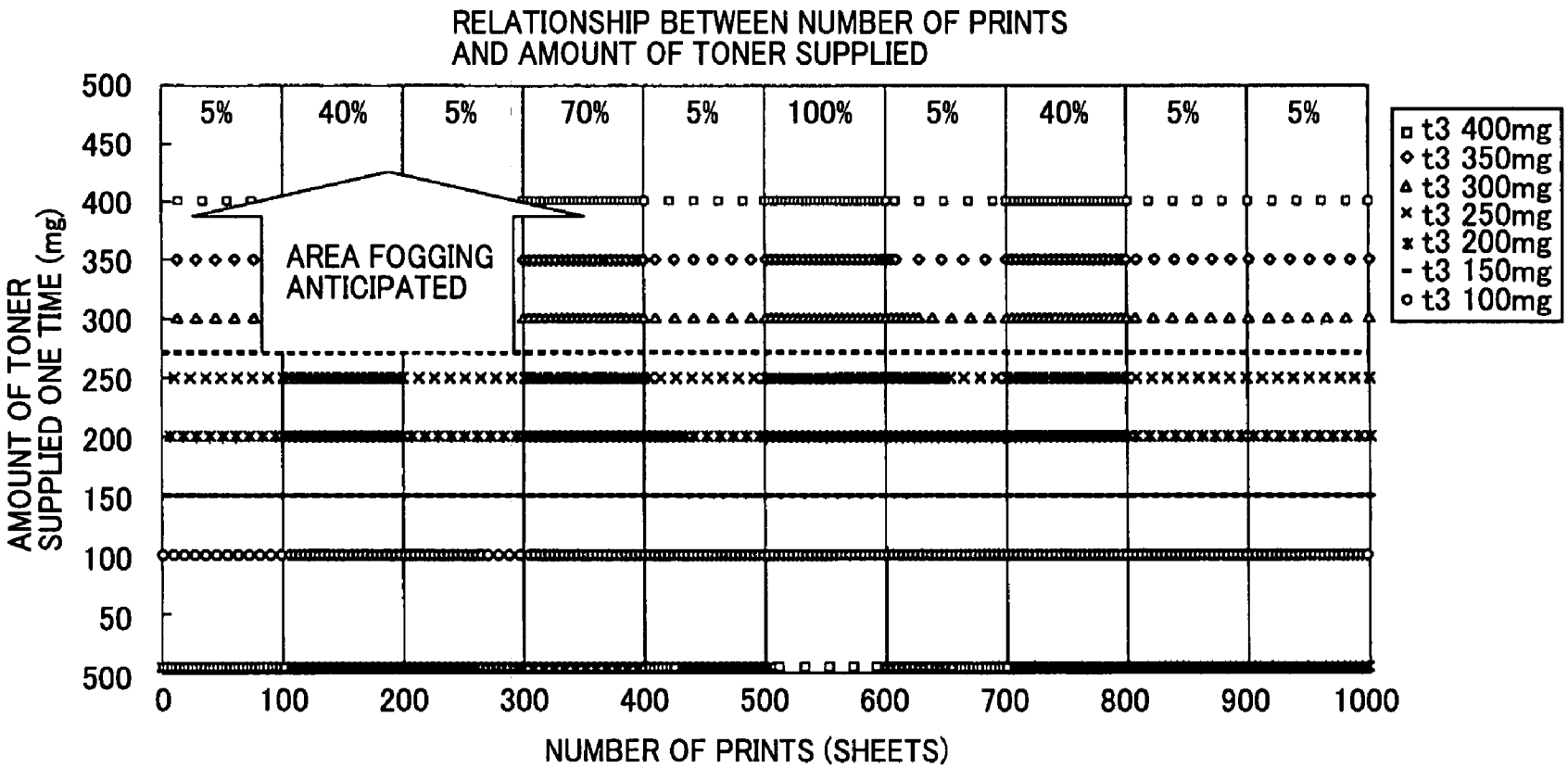
FIG. 3 is a graph showing an exemplary relationship between the number of prints and the amount of toner supplied by the image forming apparatus according to the first embodiment.

FIG. 3 is a graph showing the amount of toner supplied when 1000 sheets were printed. One plot, along the vertical axis, indicates that refilling with the amount of toner represented was performed one time.

Figure 4:
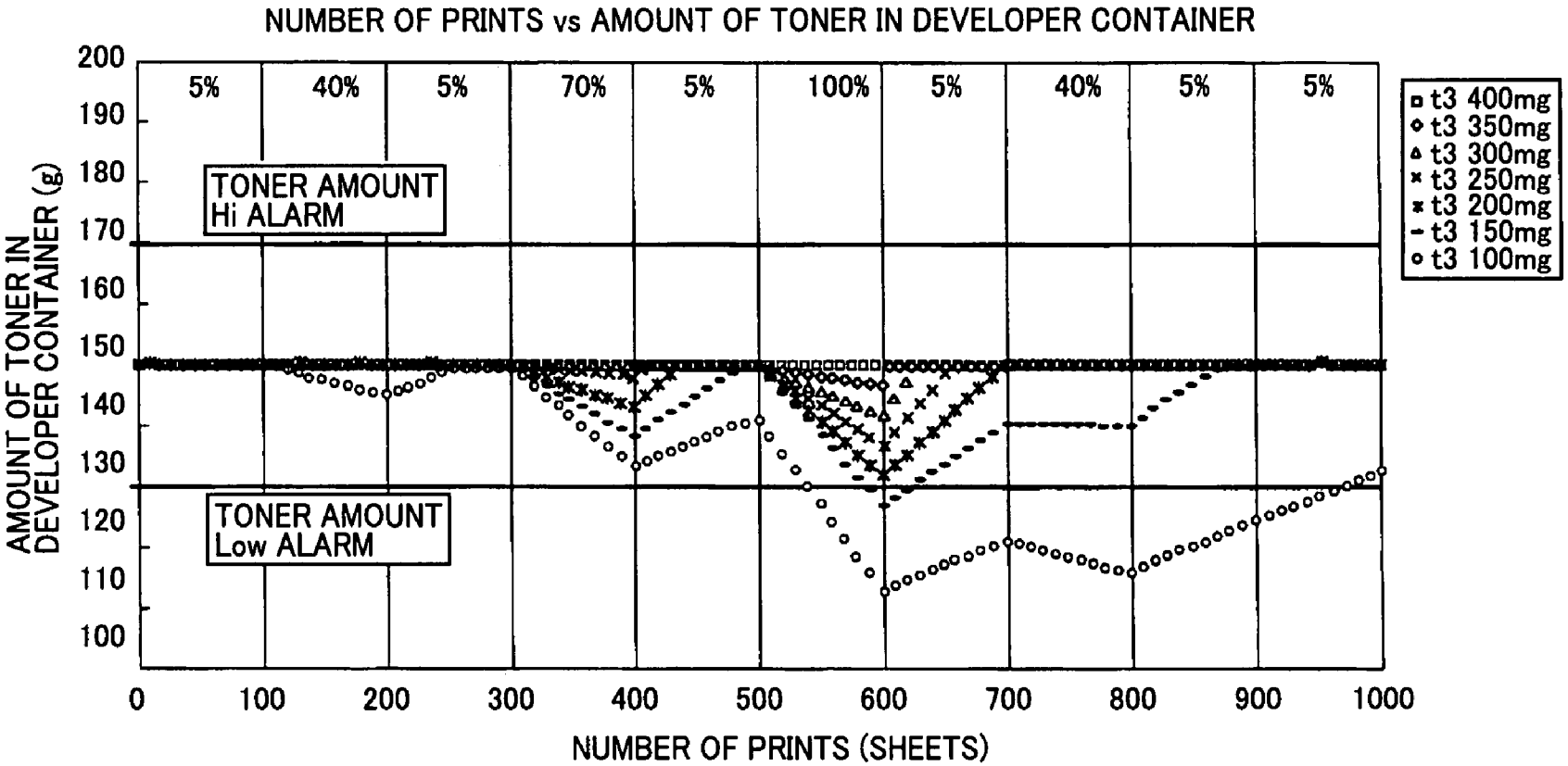
FIG. 4 is a graph showing an exemplary relationship between the number of prints and the amount of toner in the developer container of the image forming apparatus according to the first embodiment.

FIG. 4 is a graph showing the change in the amount of toner in the developer container. In the toner supply operation of this embodiment, the amount of toner to be supplied is added, and when this value exceeds the supply threshold value t3, the supply apparatus 5 is driven one time. This, as is apparent from FIG. 3, the supply operation is intermittently performed. Further, since a large amount of toner is supplied one time when the supply threshold value t3 is large, it was found that the frequency at which the supply operation was performed was reduced.

TABLE 3

| Supply threshold value t3 (mg) | Image fogging | Amount of toner in developer container Low |
|---|---|---|
| 400 | X | ○ |
| 350 | X | ○ |
| 300 | Δ | ○ |
| 250 | ○ | ○ |
| 200 | ○ | ○ |
| 150 | ○ | X |
| 100 | ○ | X |

As shown above, Table 3 provides data pertaining to supply threshold t3, image fogging, and the amount of toner contained within the developer container. Here, terms may be expressed as follows:

X: level at which image fogging on printed paper is a problem

□: level at which image fogging on printed paper is not a problem, but fogged toner is present on the photosensitive drum 51

○: level at which image fogging is not a problem toner amount Low:

X: level at which the amount of toner in the developer container becomes less than the lower limit of 130 g For 400 mg, for which the greatest value was set as the supply threshold value t3, since the supply threshold value t3 exceeded t1max (the amount of toner consumed when the maximum printing ratio is R), no sign was observed indicating that a shortage of toner existed because refilling was not performed during a period in which printing was performed at a high printing ratio, and the amount of toner in the developer container was not reduced. However, as in the conventional Example 1, image fogging occurred because too much toner was supplied while printing was performed at a high printing ratio.

The level for the image fogging, accompanied by the supply during high printing, could be lessened by reducing to 300 mg the supply threshold value t3. As for 100 mg and 150 mg, for which a smaller value was set for the supply threshold value t3, since a smaller amount of toner was supplied during the period printing was performed at a high printing ratio, image fogging did not occur. However, during high ratio printing, there was a noticeable reduction in the amount of toner in the developer container, and during the printing of an image at the printing ratio of 100% (solid black printing), the amount of toner in the developer container was reduced until it was equal to or less than 130 g, which is the level at which the toner Low alarm is released.

Also, there was an area, from 200 mg to 300 mg, for which an intermediate value was set for the supply threshold value t3, during which image fogging did not occur and the toner Low alarm was not released.

As described above, when the supply threshold value t3 is set to a value smaller than t1max, the amount of toner to be supplied for printing, at a high printing ratio, can be reduced. Therefore, the occurrence can be prevented of an image fogging phenomenon, the result of the supply and addition, at one time, of a large amount of toner, and the unsatisfactory agitation and charging that accompanies it. Thus, the arrangement is established whereby it is required that t3<t1max (the amount of toner consumed when the maximum printing ratio is R) is provided.

Further, when the supply threshold value t3 is too small, this is effective to prevent image fogging that is caused by inappropriate agitation and charging, but the amount of toner not fully supplied during printing at a high printing ratio is increased. As a result, the toner in the developer container is reduced, and the toner restoration sequence process must be performed, so that the performance of the printer is degraded.

Based on the results obtained in the embodiment, it is preferable that the range of the supply threshold value t3 be t1max*0.5<t3<t1max*0.8. This range corresponds to the range of t3=200 to 300 mg for which the preferable results were obtained for this embodiment.

However, this range of the supply threshold value t3 is changed depending on the arrangement of the developing apparatus 4 and the other parameters, and is not limited to this. Especially, the lower limit of the setup value of t3 is determined while taking into account the reduction of the toner in the developer container that is caused when refilling of toner is not caught up with printing at a high printing ratio. However, while taking into account that the actual operating state of the image forming apparatus on the market is equal to or lower than the printing ratio of 20%, and that the reduction of toner in the container does not occur until printing at a high printing ratio is performed for several hundreds of sheets, i.e., this is very rare use, the lower limit of the setup value of the supply threshold value t3 can be set to a lower value. Therefore, a preferable setup range for the supply threshold value t3 is t1max*0.2<t3<t1max*0.9

According to the method for this embodiment, the amount of toner to be supplied t1, which is calculated based on the video count, is stored as the supply addition value t2 instead of being supplied immediately. Further, the amount for refilling by the toner supply apparatus 5 at one time is employed as the supply threshold value t3, and only when the supply toner addition value t2 exceeds the supply threshold value t3, the toner supply apparatus 5 is operated. Thus, when the supply threshold value t3 is set smaller than t1max, the amount of toner supplied for printing at a high printing ratio can be reduced, so that a phenomenon can be prevented that a large amount of toner is added, and image fogging is caused by insufficiently agitating and charging the toner.

Furthermore, the amount of toner to be originally supplied for high printing ratio is stored as the addition value, instead of being supplied at one time. Therefore, when the printing process is changed from a high printing ratio to a low printing ratio, the rest of toner can be appropriately supplied, and the reduction of toner in the developer container also does not occur.

In addition, the above described operations can be performed with a simple configuration and a simple logic, without requiring a complicated supply table, or without performing correction of the supplied amount. Thus, high reliability can be provided with a simple structure.

Moreover, the amount supplied one time by the toner supply apparatus 5 is fixed, i.e., the supply apparatus 5 need only be designed that the same amount of toner is discharged every time. Therefore, unlike for the conventional apparatus, an accurate linear relation is not required between the driving time of the supply apparatus 5 and the amount of discharged toner, so that the structure of the supply apparatus 5 can be simplified.

This embodiment can be also applied for the case of employing a two-component developer containing toner and a carrier. In the case wherein the principle of the present invention is employed for the developer supply method of the developing apparatus that employs the conventional two-component developer, however, only a small amount of toner is originally present in the developing apparatus employing the two-component developer, and when refilling with toner is not immediately performed, it is predicted that the density of toner will be soon dropped, or charge-up will occur.

Therefore, this embodiment is preferable to be used for the developing apparatus of one-component supply method. That is, for this embodiment the characteristic one-component developer is employed of the developer supply method for the developing apparatus. Specifically, a specific amount of toner is present in the developer container, and when toner in the developer container is temporarily reduced during image forming at a high printing ratio, refilling the container with a little delay is sufficient so long as the total amount of toner is balanced.

As described above, according to this embodiment, a problem that appropriate agitation and charging can not be performed by adding a large amount of toner during printing at a high printing ratio can be resolved, and a request that the constant amount of toner in the developer container is maintained by accurately adding the required amount of toner can be handled at the same time.

Second Exemplary Embodiment

The feature of this embodiment is that the image forming process unit that includes at least a developing apparatus is integrally formed as a cartridge detachable to an image forming apparatus, and that a nonvolatile memory is provided as a storage unit for the cartridge, and information for an addition value t2 is stored in the nonvolatile memory. As needed, information for a supply threshold value t3 can also be stored in the nonvolatile memory of the cartridge.

Since the schematic configuration and the basic operation of the image forming apparatus in this embodiment are similar to those in the first embodiment, the explanation for the first embodiment will be summarized to avoid repetition of the description. The cartridge will now be described.

Figure 5:
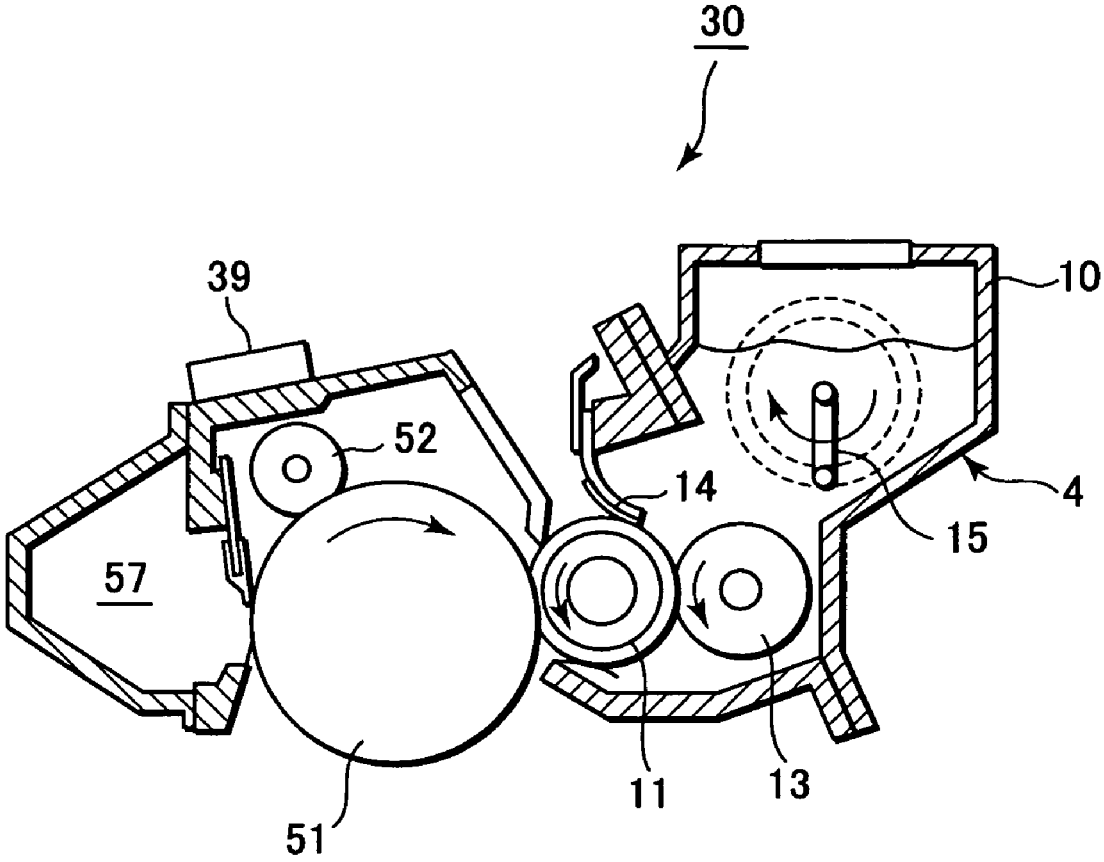
FIG. 5 is a cross-sectional view of an exemplary arrangement of a process cartridge employed for an image forming apparatus according to a second embodiment of the present invention.

FIG. 5 is a schematic diagram showing an exemplary structure of a cartridge employed for this embodiment. In this embodiment, a cartridge 30 is provided by integrally forming a photosensitive drum 51, as explained in the first embodiment, and a charging roller 52, a developing apparatus 4 and a cleaning apparatus 57, all of which are process components that act to the photosensitive drum 51 for image forming. This cartridge 30 is detachable to a main body 100A of an image forming apparatus. However, in an alternative embodiment, only the developing apparatus 4 can also be provided as a cartridge detachable to the image forming apparatus. Especially, a process cartridge wherein the photosensitive drum 51 and at least the developing apparatus 4 that serves as process components are integrally formed is widely employed. According to this embodiment, a storage device, such as a nonvolatile memory 39, is provided for the cartridge 30.

Figure 6:
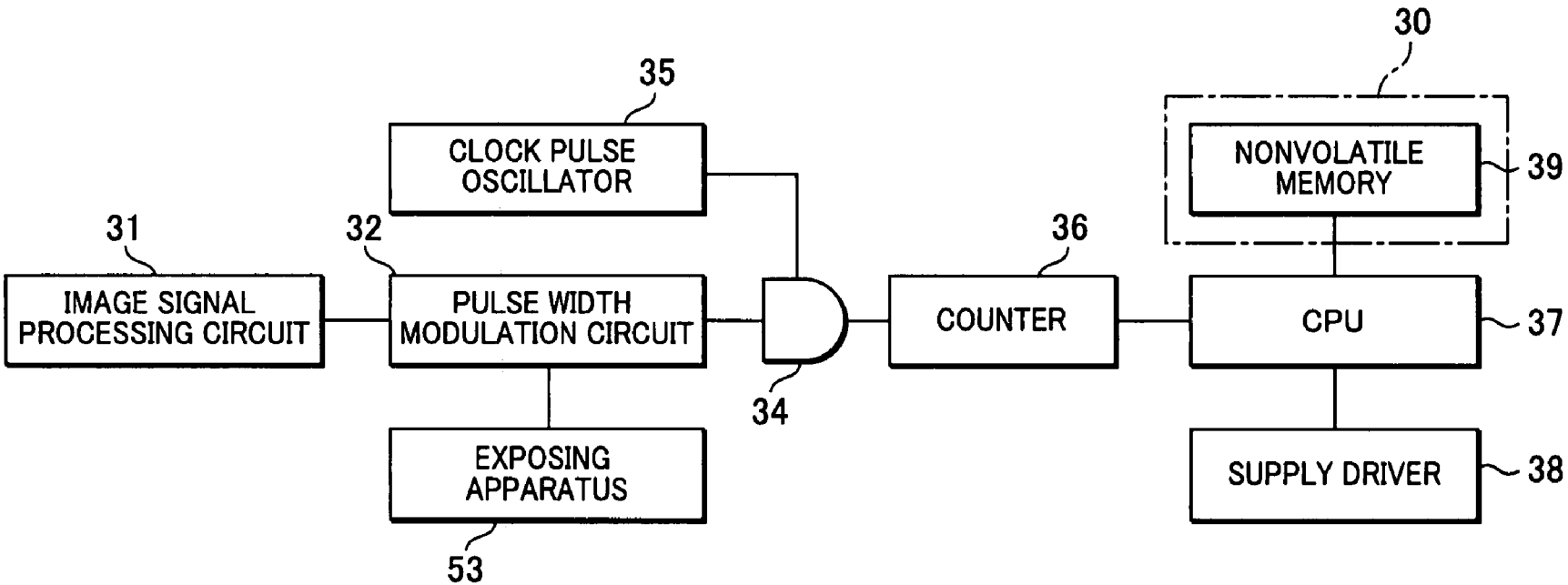
FIG. 6 is a block diagram showing an exemplary configuration of the image forming apparatus according to the second embodiment.

FIG. 6 is a block diagram showing an exemplary configuration of an image forming apparatus 100 in this embodiment. The arrangement of an image signal processing section is similar to that for the first embodiment, i.e., the arrangement of the image signal processing section of the conventional image forming apparatus explained while referring to FIGS. 15 and 16.

A difference of this embodiment is that, as shown in FIG. 6, before a CPU 37 calculates an addition value t2 for the amount of toner to be supplied, the CPU 37 reads an addition value from the nonvolatile memory 39 of the cartridge 30, and that the addition value stored in the nonvolatile memory 39 is to be appropriately overwritten and updated with a new addition value t2 obtained by the calculation.

Figure 2:
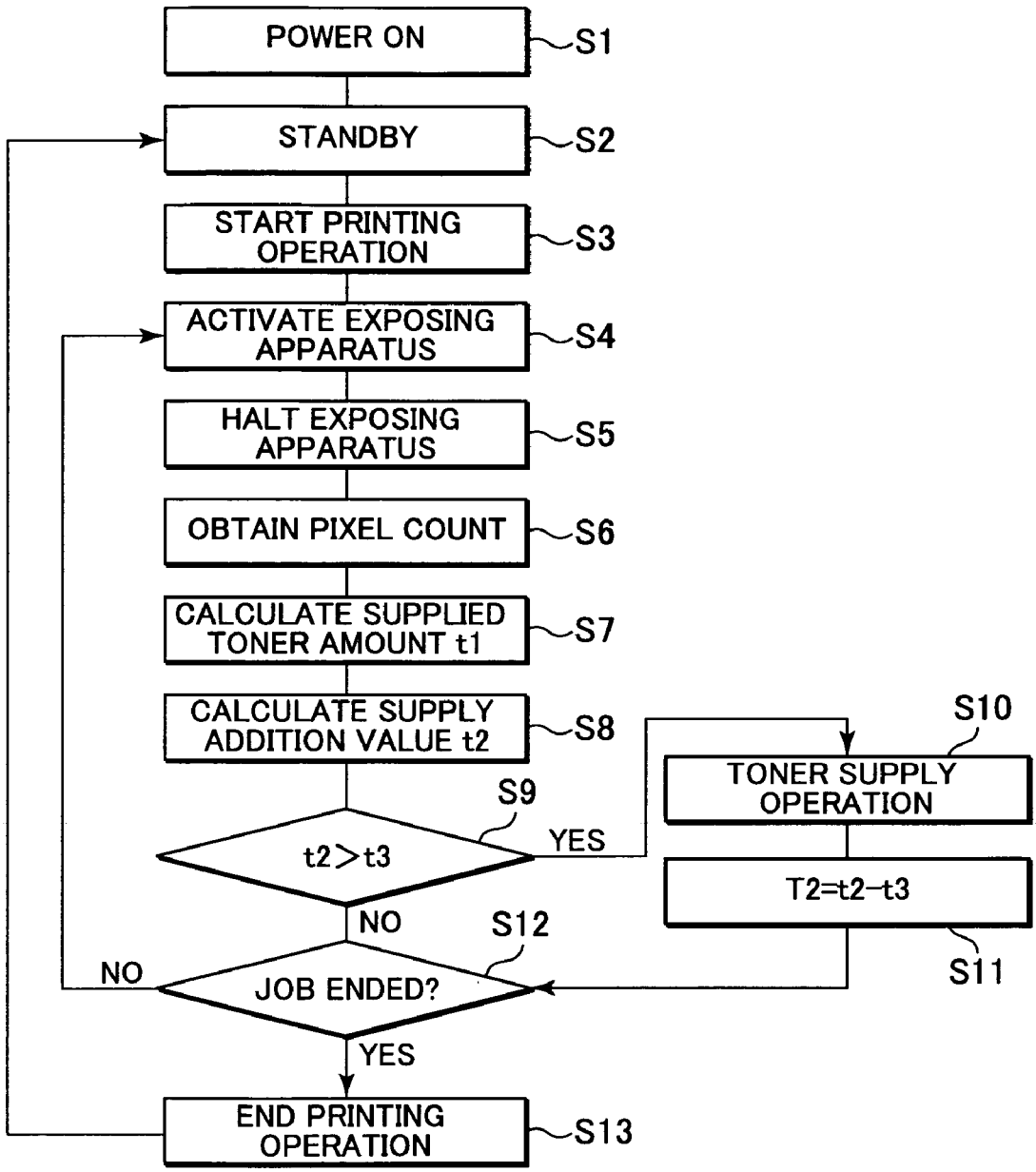
FIG. 2 is a flowchart of an exemplary operation of the image forming apparatus of the first embodiment.
Figure 7:
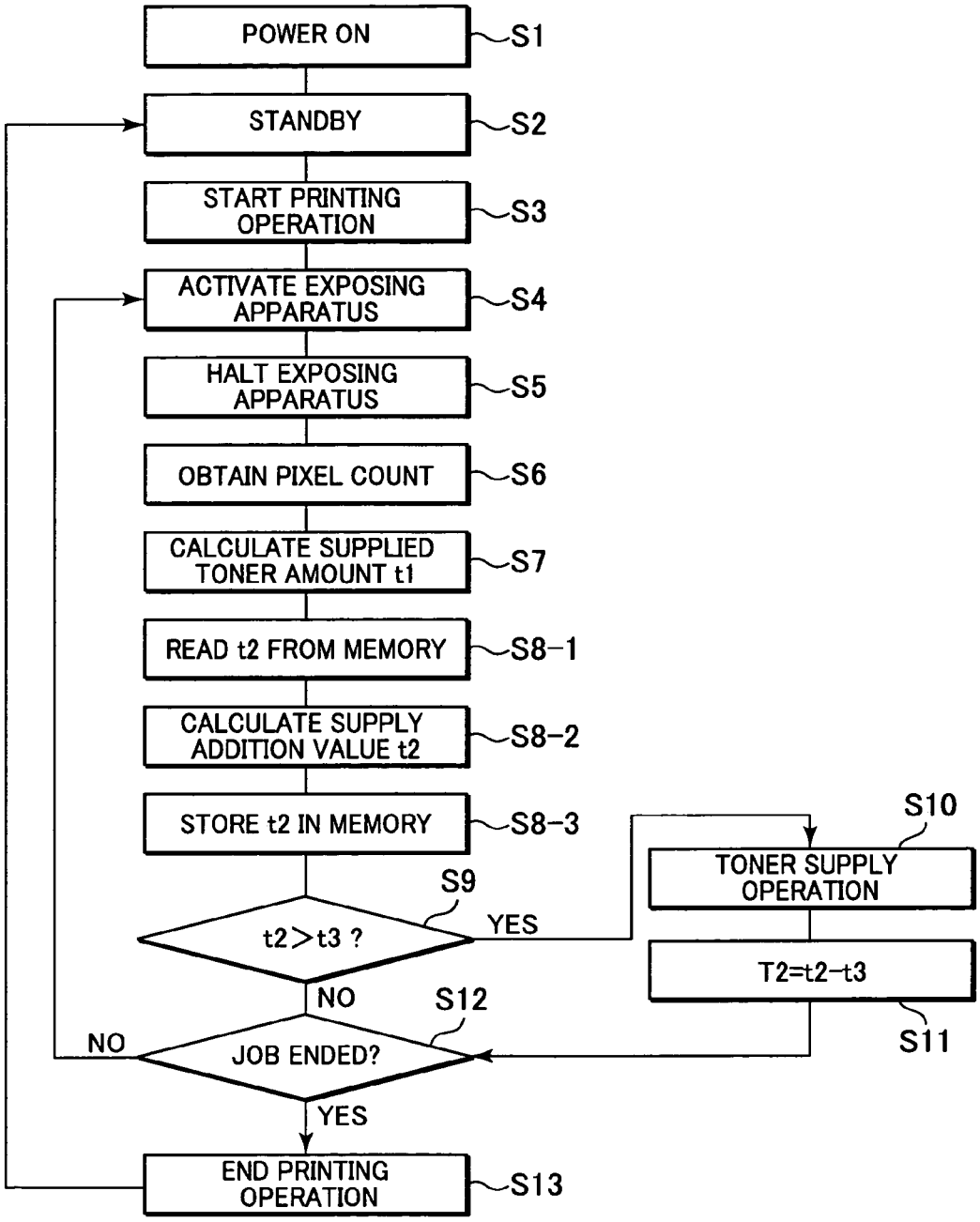
FIG. 7 is a flowchart of an exemplary operation of the image forming apparatus of the second embodiment.

More specifically, the flowchart in FIG. 7 is similar to the flowchart in FIG. 2 employed for the first embodiment, except for the following difference. According to the first embodiment, at step S7 and step S8, the CPU 37, which controls the operation of the image forming apparatus 100, employs the video count value to calculate, for each image forming process, the amount of toner to be supplied, calculates the addition value t2 that is the amount of toner that is the sum of the amounts of toner to be supplied t1 (S7 and S8), and compares the addition value t2 with the supply threshold value t3 (S9). The supply threshold value t3 can be stored in the storage unit of the CPU 37, or in the nonvolatile memory 39 of the cartridge 30.

Now referring to FIG. 7, the processing in this embodiment includes steps S7, S8-1, S8-2 and S8-3. As well as in the first embodiment, the CPU 37 employs the video count value to calculate, for each image forming process, the amount of consumed toner, i.e., the amount of toner to be supplied t1 (S7). Further, for calculation of a toner supply addition value t2, the CPU 37 reads an addition value t2 that is stored in the nonvolatile memory 39 of the cartridge 30 and that is the sum of the amounts of toner supplied up to the previous image forming operation (S8-1), and calculates a new addition value t2 (S8-2). Then, the CPU 37 compares the latest supply addition value t2 with the supply threshold value t3 (S9). The new addition value t2 is stored in the nonvolatile memory 39 by overwriting the previous addition value t2 in the nonvolatile memory 39 (S8-3).

Since the toner supply operation in the flowchart in FIG. 7 for the embodiment is the same as the toner supply operation in the flowchart in FIG. 2 for the first embodiment, except for the processes at steps 8-1, 8-2 and 8-3, the same reference step numbers are provided for the same processes to quote the explanation used for the first embodiment, and the repetition of the explanation is avoided.

Figure 8:
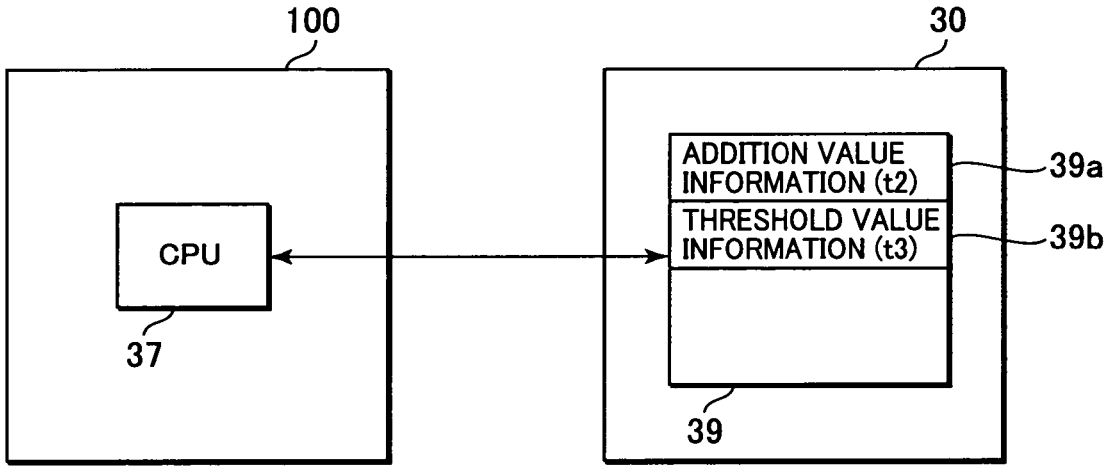
FIG. 8 is a diagram showing an exemplary storage state of a nonvolatile memory provided for the process cartridge of the second embodiment.

FIG. 8 is a diagram showing the storage state of the nonvolatile memory 39 of the cartridge 30. Information writing and reading relative to the nonvolatile memory 39 is performed by the CPU 37 of the image forming apparatus 100. Storage areas are provided for the nonvolatile memory 39; in this embodiment, a storage area 39*a* for storing supply addition value information (t2) and a storage area 39*b* for storing supply threshold value information (t3) are provided.

According to this embodiment, the supply addition value t2 is regarded as a temporary shortage of toner to be added to the developer container. When the above described arrangement is employed, the addition value t2 is always presented for the developer container. Assume that the developing apparatus 4 is removed from the image forming apparatus 100 while the image forming is currently performed at a high printing ratio and a large addition value t2 is stored. Since the amount of toner to be added is stored in the nonvolatile memory of the developer container, when the developer container is set again to the image forming apparatus 100, the temporary shortage of the amount of toner to be added can be made up. Therefore, reduction of toner in the developer container, malfunctioning of the developer container does not occur.

As a result, the supply control operation explained in the first embodiment can also be appropriately performed when the developing apparatus 4 is detached from the image forming apparatus 100.

Further, since the cartridge form is employed, the parts can be exchanged easily, and the maintenance of the image forming apparatus can be improved. Furthermore, since the important electrophotographic parts are replaced with new ones by exchanging cartridges, a high image quality can be always maintained.

Third Exemplary Embodiment

The feature of a third embodiment is that the operation explained in the second embodiment is performed by a color image forming apparatus with a plurality of process cartridges, and that a supply threshold value t3 is also stored in nonvolatile memories of these process cartridges.

Figure 9:
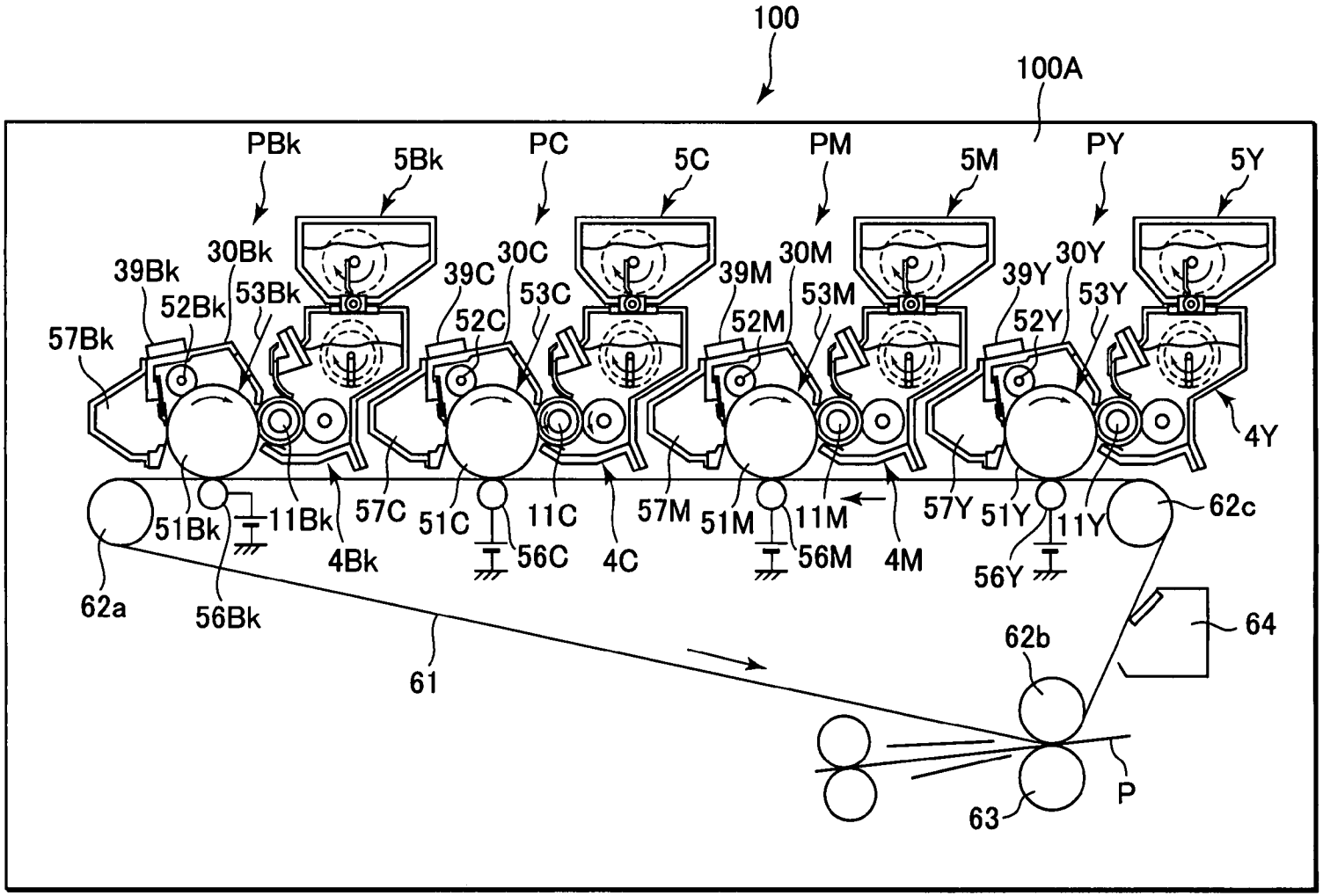
FIG. 9 is a cross-sectional view of an exemplary configuration of an image forming apparatus according to a third embodiment of the present invention.
Figure 10:
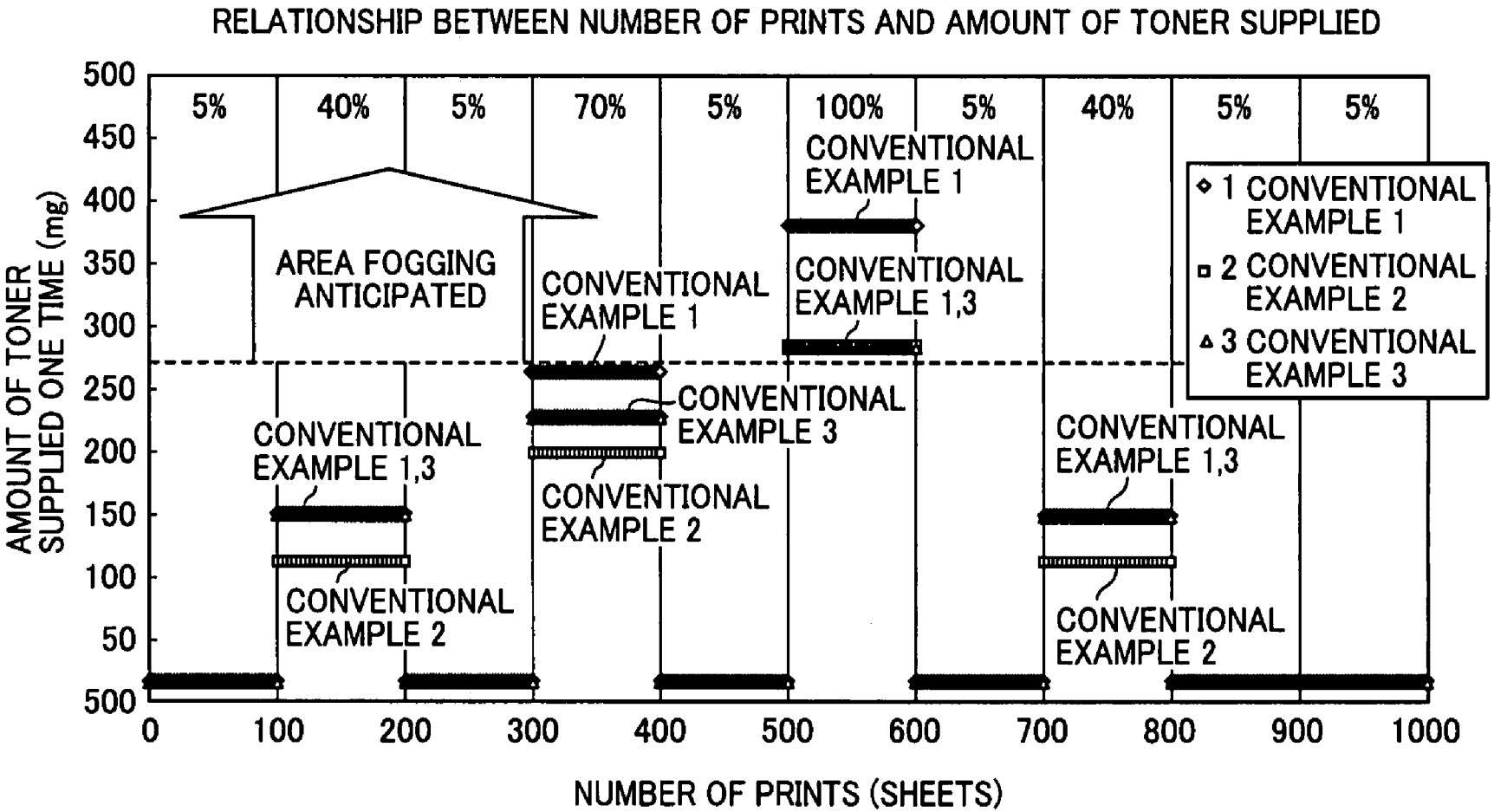
FIG. 10 (PRIOR ART)
FIG. 10 is a graph showing an exemplary relationship between the number of prints and the amount of toner supplied by a conventional image forming apparatus.
Figure 11:
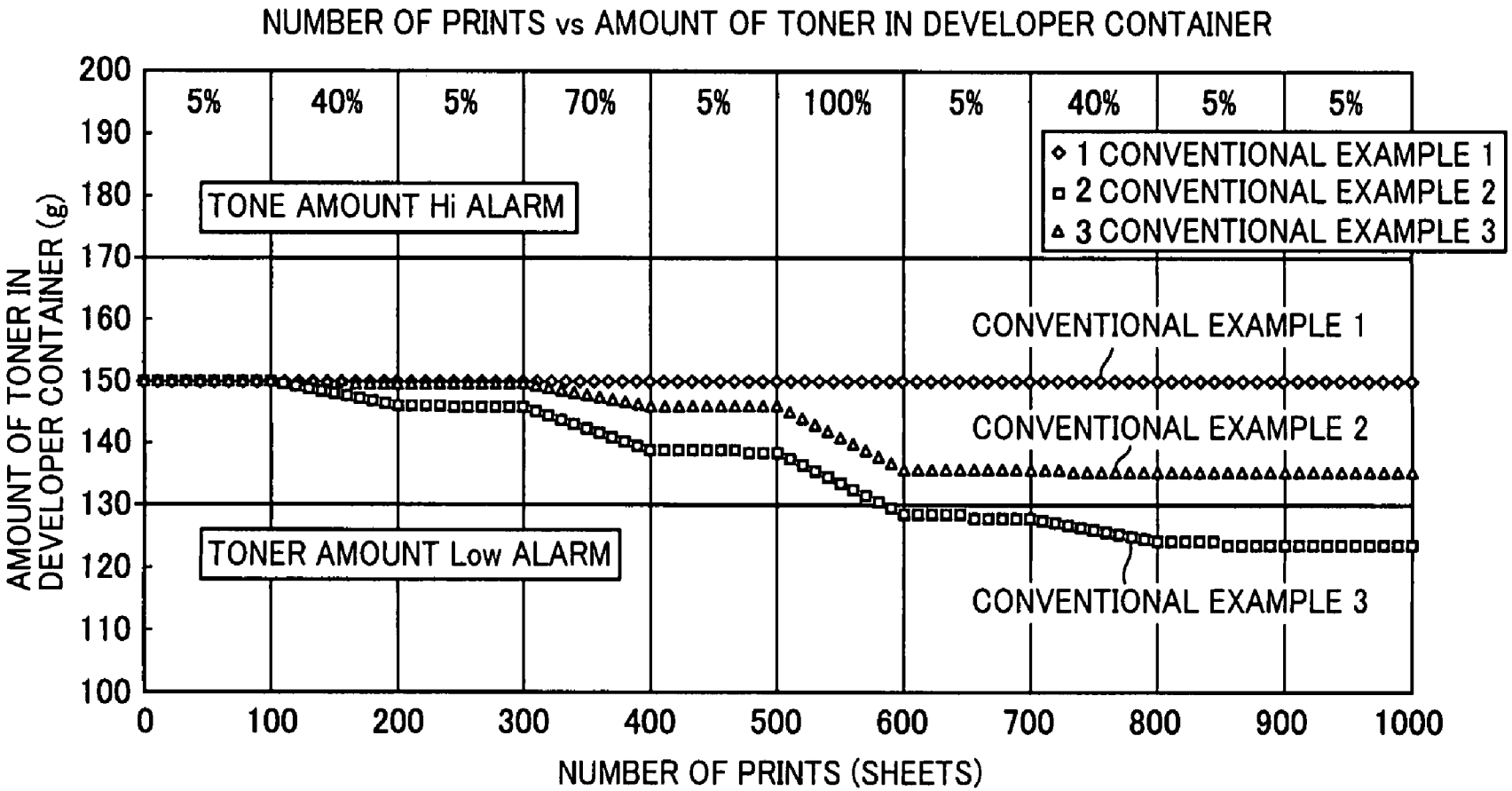
FIG. 11 (PRIOR ART)
FIG. 11 is a graph showing an exemplary relationship between the number of prints and the amount of toner in the developer container of a conventional image forming apparatus.
Figure 12:
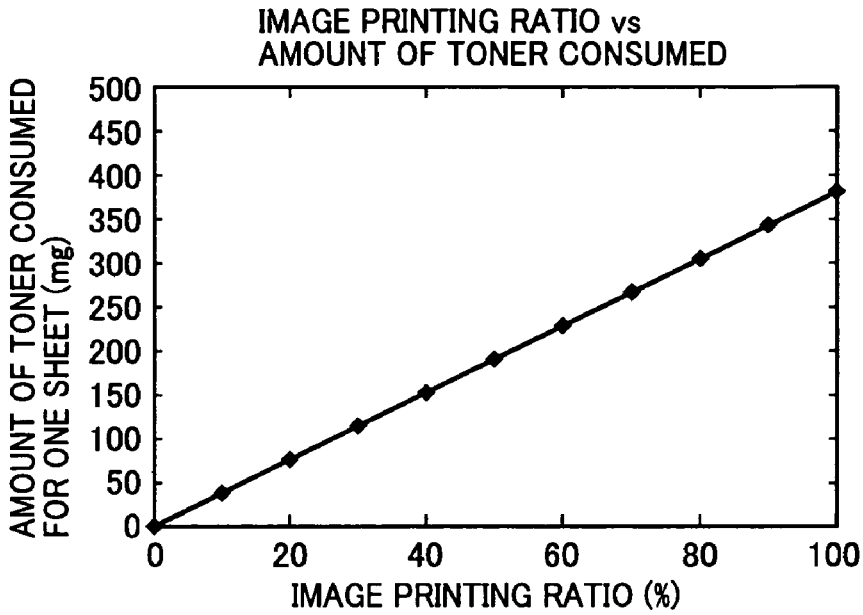
FIG. 12 (PRIOR ART)
FIG. 12 is a graph showing a conventional relationship between an image printing ratio and the amount of toner supplied.
Figure 13:
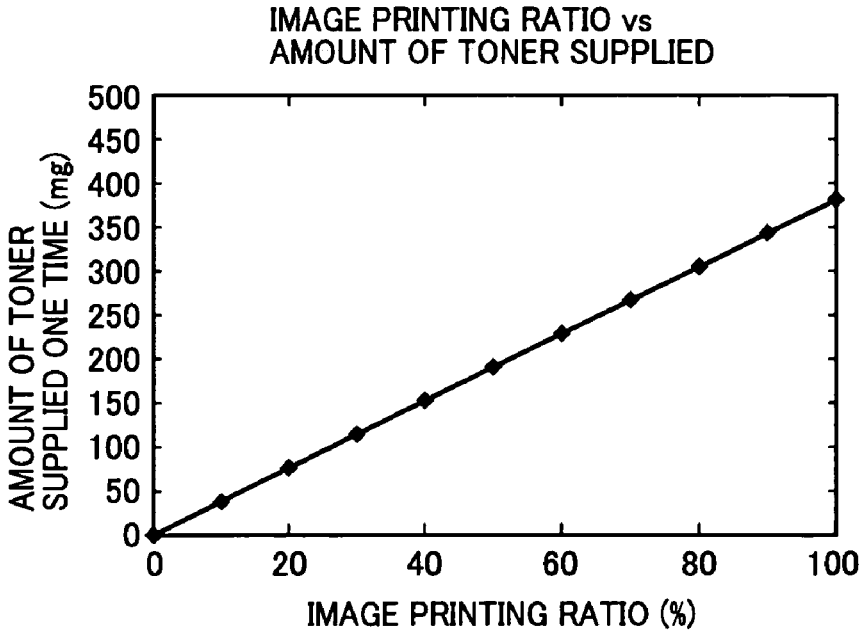
FIG. 13 (PRIOR ART)
FIG. 13 is a graph showing a conventional relationship between an image printing ratio and the amount of toner supplied.
Figure 14:
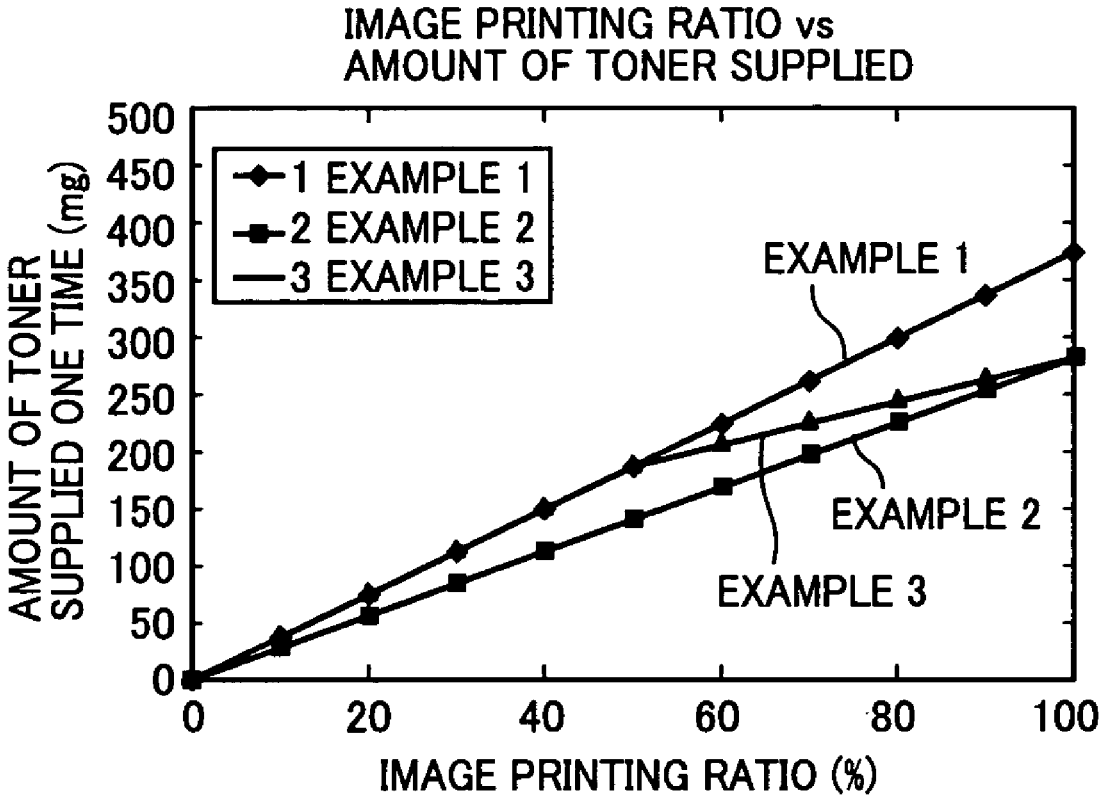
FIG. 14 (PRIOR ART)
FIG. 14 is a graph showing a conventional relationship between an image printing ratio and the amount of toner supplied.

FIG. 9 is a diagram showing an example color image forming apparatus of tandem intermediate transferring type according to this embodiment. According to this embodiment, a main body 100A of an image forming apparatus 100, four image forming units, i.e., four image forming stations P (PY, PM, PC and PBk) are arranged in series in the image feeding direction. The image forming stations P (PY, PM, PC and PBk) include, respectively, electro-photographic photosensitive members in a drum shape, i.e., photosensitive drums 51 (51Y, 51M, 51C and 51Bk), which serve as image bearing members; electrifiers 52 (52Y, 52M, 52C and 52Bk), which are charging rollers serving as a charging units; exposing apparatuses 53 (53Y, 53M, 53C and 53Bk), which are laser beam scanner units serving as an exposure units; developing apparatuses 4 (4Y, 4M, 4C and 4Bk), which serve as a developing unit; cleaning apparatuses 57 (57Y, 57M, 57C and 57Bk), which serve as a cleaning units having a cleaning blade; and primary transferring apparatuses 56 (56Y, 56M, 56C and 56Bk), which serve as transferring rollers serving as a primary transferring units.

The photosensitive drums 51 (51Y, 51M, 51C and 51Bk), the electrifiers 52 (52Y, 52M, 52C and 52Bk), the developing apparatuses 4 (4Y, 4M, 4C and 4Bk) and the cleaning apparatuses 57 (57Y, 57M, 57C and 57Bk), which constitute the individual image forming stations P (PY, PM, PC and PBk), are integrally formed to provide cartridges 30 (30Y, 30M, 30C and 30Bk). The cartridges 30 in this embodiment have similar as that of the cartridge 30 explained in the second embodiment, while referring to FIG.

Furthermore, toner supply apparatuses 5 (5Y, 5M, 5C and 5Bk), which are similar the toner supply apparatus 5 in the first embodiment, are arranged in the image forming apparatus so as to be replaceable. The structure and the operation for the photosensitive drums 51, the developing apparatuses 4, the electrifiers 52 and the other components of the individual process cartridges 30 are similar to those in the first and the second embodiments. Therefore, the same reference numerals are provided to denote members that have the same structures and the same functions as those for the cartridge 30 and the toner supply apparatus 5 in the first and the second embodiments, and no further explanation for them will be given by quoting the explanation in the first and the second embodiments.

Figure 15:
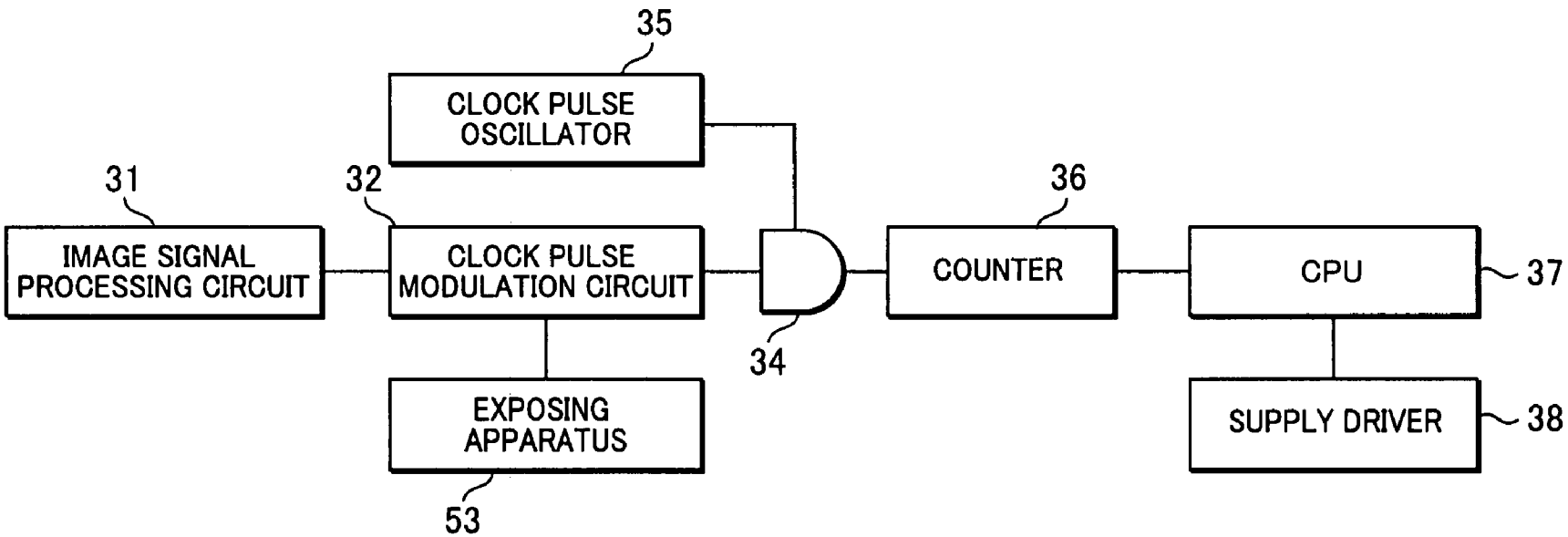
FIG. 15 (PRIOR ART)
FIG. 15 is a block diagram showing the configuration of a conventional image forming apparatus.
Figure 16:
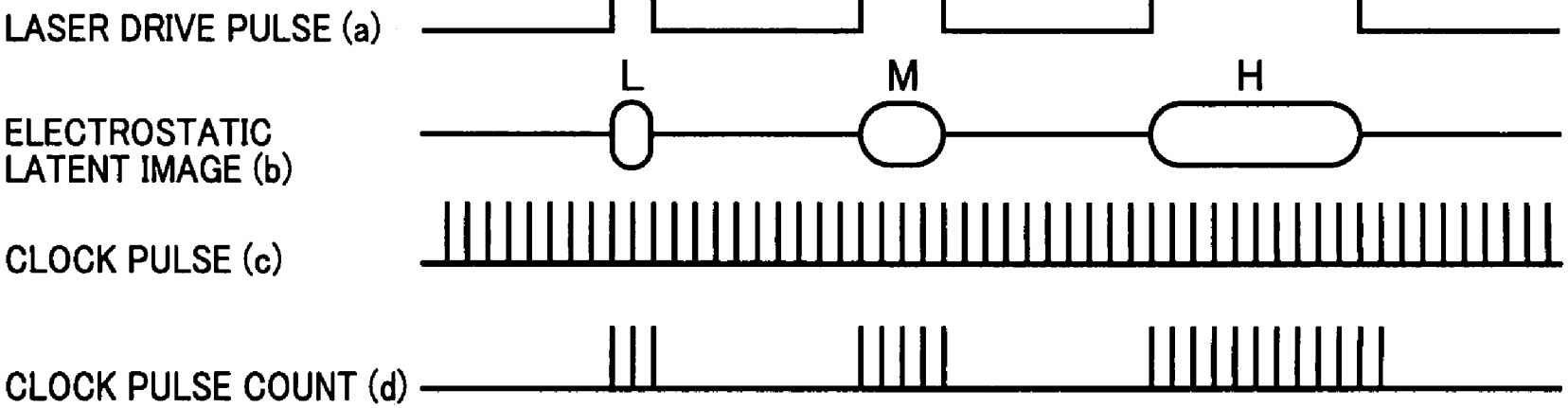
FIG. 16 (PRIOR ART)
FIG. 16 is a diagram for a conventional video count measurement method.
Figure 17:
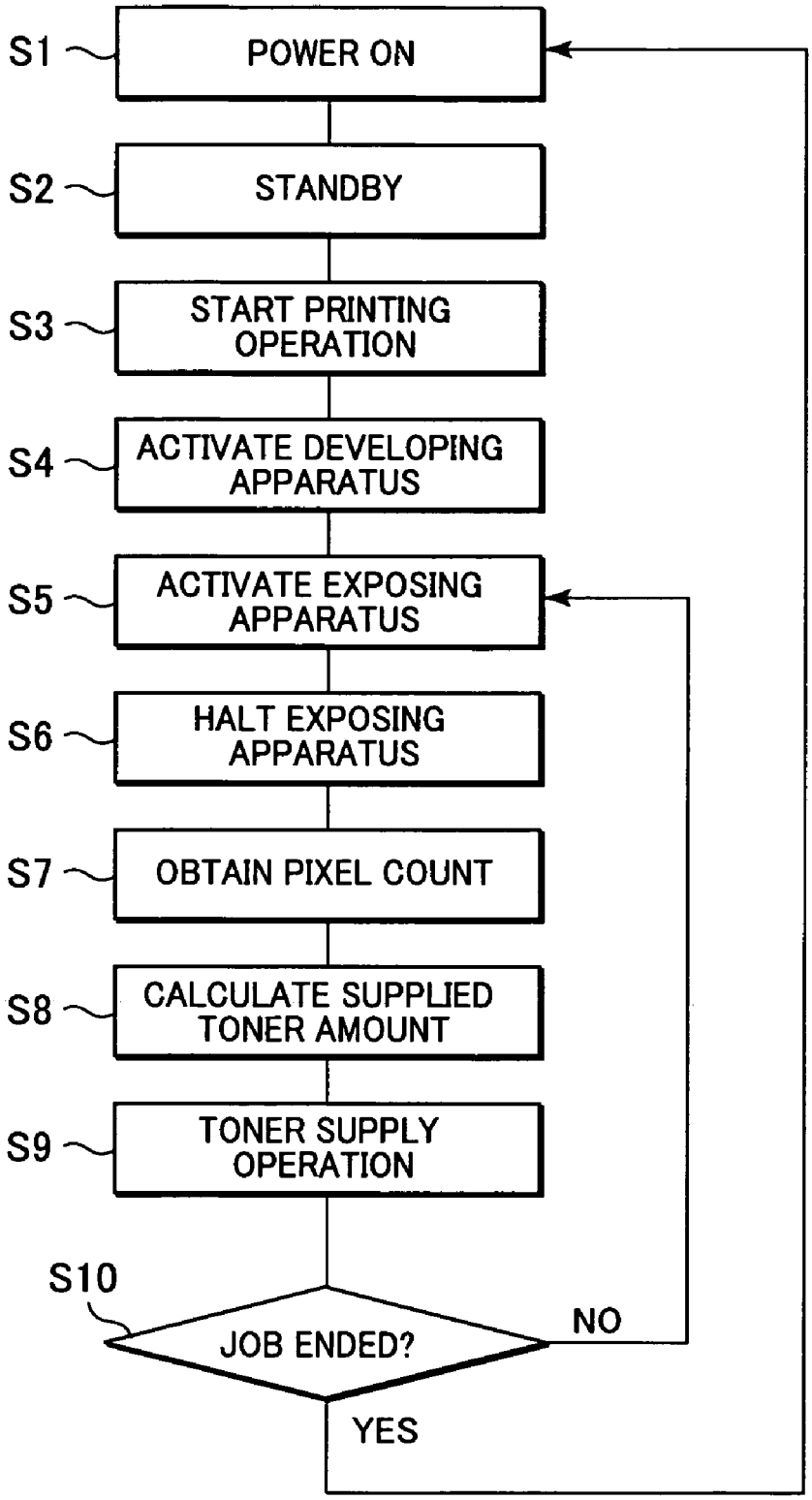
FIG. 17 (PRIOR ART)
FIG. 17 is a flowchart for the operation of the conventional image forming apparatus.

Furthermore, the arrangement for the image signal processing section to obtain a video count is the same as explained in the first embodiment, i.e., the structure for the image signal processing section of the conventional image forming apparatus explained while referring to FIGS. 15 and 16, and the structure as explained in the second embodiment while referring to FIG. 6. Thus, no further explanation for the image signal processing section will be given by quoting the explanation employed for the first or the second embodiment.

According to the image forming apparatus in this embodiment, an intermediate transferring belt 61, which is an intermediate transfer member in a belt shape, is extended between support rollers 62*a*, 62*b* and 63*c* through the gaps between the photosensitive drums 51 (51Y, 51M, 51C and 51Bk) and the primary transfer apparatuses 56 (56Y, 56M, 56C and 56Bk) of the image forming stations P (PY, PM, PC and PBk), and can travel in a direction indicated by arrows.

In this embodiment, light sources and polygon mirrors, which constitute the exposing apparatuses 53, are also arranged above the main body 100A, and electrostatic latent images consonant with image signals are formed respectively on the photosensitive drums 51 (51Y, 51M, 51C and 51Bk).

Predetermined amounts of one-component developers, which are non-magnetic yellow, magenta, cyan and black toners, are filled in the respective developing apparatuses (4Y, 4M, 4C and 4Bk). Using toners of individual colors, the latent images on the photosensitive drums 51 are sequentially developed by developing rollers 11 (11Y, 11M, 11C and 11Bk) to form toner images, and the toner images are transferred to the intermediate transferring belt 61.

Then, a transferring material P stored in a transferring cassette (not shown) is conveyed to a second transferring roller 63 that serves as a second transferring apparatus that is a second transferring unit, and the toner images carried on the intermediate transferring belt 61 is transferred to the transferring material P. The toner images on the transferring material P are fixed by a fixing apparatus (not shown) by heat and pressure, and the transferring material P with the thus obtained full color image is discharged outside the image forming apparatus.

In addition, an intermediate transfer belt cleaning apparatus 64 is located downstream from the position of the second transfer to the transferring material P in the direction in which the intermediate transferring belt 61 travels. Fogged toner attached to the surface of the intermediate transferring belt 61, or the secondary transfer residual toner is removed by this cleaning apparatus 64.

Toner remaining on the photosensitive drums 51 (51Y, 51M, 51C and 51Bk) after the primary transfer process is removed by the photosensitive drum cleaning apparatuses 57 (57Y, 57M, 57C and 57Bk). For the above described full color image forming apparatus, since multiple color images are superimposed on a single sheet, a much higher fogging level than that of a monochrome model is requested. The toner supply method of this embodiment can also be appropriately employed for such a full color image forming apparatus.

Further, since the supply threshold value t3 is stored in the nonvolatile memories 39 (39Y, 39M, 39C and 39Bk) of the individual process cartridges 30 (30Y, 30M, 30C and 30Bk), providing of supply threshold values t3 unique to the developing apparatuses is enabled.

Therefore, in this embodiment, the optimal supply threshold value t3 can be separately provided in accordance with the cartridge manufacturing condition, or a different supply threshold value t3 can be provided depending on a toner color, so that the image forming apparatus can be operated by always employing the optimal supply threshold value.

Fourth Exemplary Embodiment

Since the schematic configuration and the basic operation of an image forming apparatus according to a fourth embodiment of the present invention is similar to the first embodiment, no further explanation for this will be given by quoting the explanation employed for the first embodiment.

Figure 19:
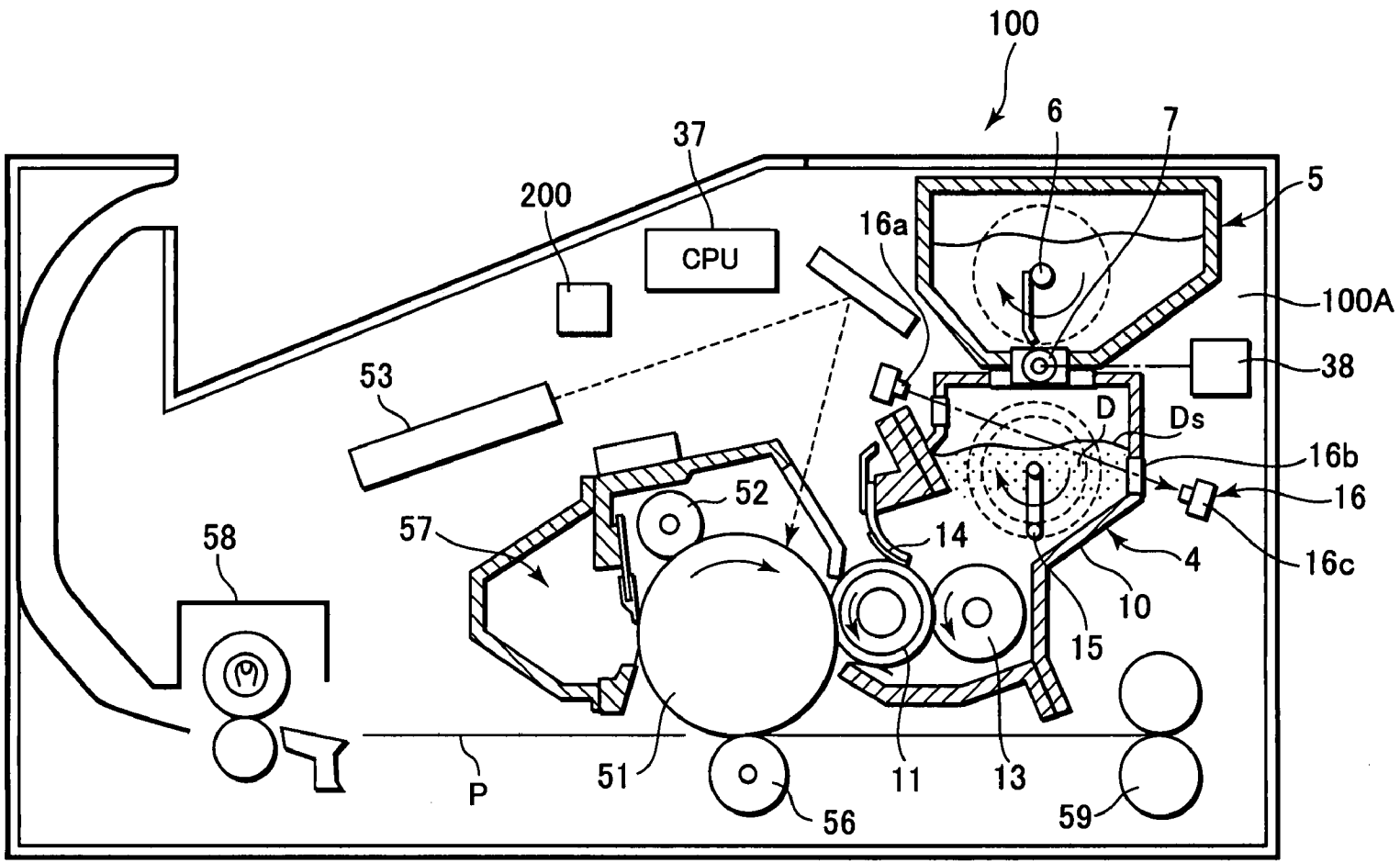
FIG. 19 is a cross-sectional view of an exemplary configuration of an image forming apparatus according to a fourth embodiment of the present invention.

An environment sensor 200, which detects the temperature and humidity in the periphery, is mounted to a main body 100A of an image forming apparatus 100 shown in FIG. 19 for the instant embodiment. By converting the values of the detected temperature and humidity into the absolute water volume, the environment condition in the periphery of a developing apparatus 4 can be identified.

Further, in this embodiment, as service life information of the developing apparatus, print count information (use amount information), consumed toner volume information and supplied toner volume information are stored in the storage unit (not shown) of a CPU 37 that is a control unit provided for the main body 100A.

In an exemplary toner supply operation for this embodiment, the amount of toner consumed in the image forming process (t1), which is calculated based on the printing ratio, is added to obtain a supply addition value (t2). When the supply addition value (t2) is greater than a supply threshold value (t3), i.e., t2>t3 is established, a toner supply apparatus 5 is started to perform toner refilling, and the supply threshold value (t3) is subtracted from the addition value (t2). At this time, it is assumed that the supply threshold value (t3) is variable based on both the environmental state in the periphery of the developing apparatus and the service life information of the developing apparatus 4, or based on at least either information.

The toner supply operation performed for this embodiment will be described in detail. The toner supply operation in this embodiment has the following characteristic. When the amount of consumed toner (t1) is calculated based on a video count, instead of refilling, the obtained amount (t1) is stored as an addition value (t2) in the storage unit of the CPU 37 provided for the main body 100A. As for the amount of toner that the toner supply apparatus supplies by one operation, a supplied toner amount correction coefficient ($\alpha$), which is information related to the supply threshold value (t3), is determined based on both the service life information of the developing apparatus and the environment information, or based on at least either information. Then, the supply threshold value (t3) is corrected by using the correction coefficient ($\alpha$), and a corrected supply threshold value (t4) is determined. When the addition value (t2) for the amount of toner to be supplied exceeds the corrected supply threshold value (t4), the toner supply apparatus is started at one time.

The list of parameters employed for this embodiment is as follows:

A: the amount of toner carried on a photosensitive drum for development 0.6 mg/cm$^2$ S: paper size (A4 size) 21.0*29.7 cm R: image printing ratio calculated based on a video count 0 to 100% t1: the amount of toner to be supplied for one sheet (=the amount of toner consumed for one sheet)

t1=A*S*R, and the available range of t1 is 0 to 374 mg t2: the accumulated amount of toner t3: supply threshold value (=the amount of toner the toner supply apparatus supplies by one operation)

α: supplied toner amount correction coefficient t4: corrected supply threshold value (t4=t3*α)

Pa: the number of printed sheets

L: the limit number of prints for the service life of the developing device

The amount of carried toner (A) and the size of paper (S) are numerical values to be corrected as needed in accordance with the paper size detection or toner patch density detection by the image forming apparatus. In the examination in this embodiment, fixed values were employed in order to reduce influence factors.

The exemplary toner supply operation will now be explained while referring to the flowchart in FIG. 20. When the main body 100A of the image forming apparatus 100 is powered on (S11), and a predetermined activation process is completed, the image forming apparatus 100 becomes standby (S12).

When a print signal is received in the standby state, a temperature and a humidity are detected by the environment sensor 200, which is mounted to the main body 100A and serves as a temperature/humidity detection unit, and are converted into the absolute water volume. When the absolute water volume is greater than 18.0 [g/g (760 mmHg)], the environment is regarded as at a high temperature with a high humidity. When the absolute water volume is smaller than 5.8 [g/g (760 mmHg)], the environment is regarded as at a low temperature with a low humidity. In this manner, the environment information is obtained (S13).

Following this, in this embodiment, print count information (Pa) is read from the memory of the CPU 37 (S14), and the limit number of prints for the service life of the developing device (L) and the current print count (Pa) are employed to calculate [100−(Pa*100)/L), and the remaining service life of the developing apparatus (S15). Then, the correction coefficient (α) is determined by using both the environment information, which indicates the state of the developing apparatus, and the developing apparatus service life information (use amount information), or using at least either information.

After the correction coefficient (α) is obtained, a corrected supply threshold value (t4) is calculated by multiplying the supply threshold value (t3) and the correction coefficient (α), and the amount of toner equivalent to the corrected supply threshold value (t4) is defined as the amount of toner to be supplied by one supply operation (S16).

Thereafter, the printing operation is started, and the photosensitive drum 51, the electrifier 52 and the exposing apparatus 53 are sequentially activated (S17). When it is about time that these apparatuses are ready, the exposing apparatus 53 is operated to form a latent image (S18), and at the same time, acquisition of video (pixel) count data is begun. When the latent image has been formed, the exposing apparatus 53 is halted (S19), the video count addition is also ended, and a video count value is obtained (S20).

The CPU 37 employs the video count value to calculate the amount of consumed toner, i.e., the amount of toner to be supplied (t1), and calculates the supply addition value (t2) (S21 and S22). Sequentially, the supply addition value (t2) is compared with the corrected supply threshold value (t4) (S23). When the supply addition value (t2)≦the supply threshold value (t4), supply of toner is not performed. When the supply addition value (t2)>the supply threshold value (t4), the amount of toner equivalent to the supply threshold value (t4) is supplied one time. Then, the supply threshold value (t4) equivalent to the supplied amount is subtracted from the supply addition value (t2), and addition is continued to the remaining value (S24 and S25).

In order to supply the amount of toner (t4) after the supply threshold value (t3) has been corrected, the number of revolutions of a supply motor that constitutes a supply driver 38 need only be adjusted.

Figure 22:
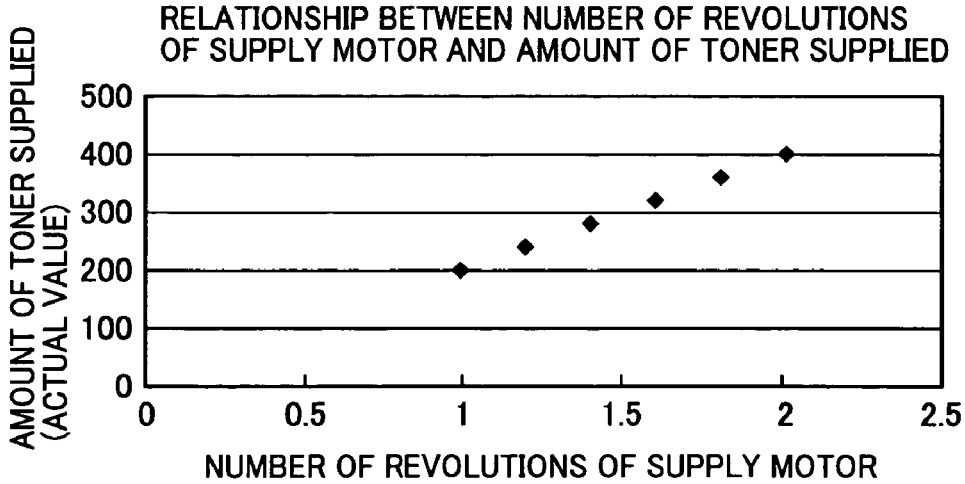
FIG. 22 is a graph showing an exemplary relationship between the number of revolutions of the supply motor of the image forming apparatus of the fourth embodiment and the amount of toner supplied.

FIG. 22 is a graph showing the relation between the number of revolutions of the supply motor and the amount of supplied toner. 400 mg of toner is supplied by two revolutions of the supply motor, and half the toner, i.e., 200 mg, is supplied by one revolution of the supply motor. Further, 40 mg of toner is supplied by 0.2 revolution. Since the number of revolutions of the supply motor are adjusted in accordance with the correction coefficient (α), the target amount of toner to be supplied can be obtained. It is noted that in this embodiment, 400 mg of toner is to be supplied when α=1.

Referring again to FIG. 20, a check is performed to determine whether the job is completed (S26). When the job is not yet ended, and there are still more sheets to be printed, program control returns to step 18, and the image forming apparatus 100 enters the next process cycle and starts the exposing apparatus 53. When there is no more sheets to be printed for the job, the individual apparatuses are sequentially halted, and the image forming operation is terminated (S27). Program control thereafter returns to step 12, and the image forming apparatus 100 is set to standby state.

When the corrected threshold value (t4) is set smaller than t1max, the amount of toner supplied during image forming at a high printing ratio can be reduced. Therefore, it is possible to prevent image fogging that is caused when a large amount of toner is supplied at one time and agitating and charging of toner is insufficiently performed. However, when a too small supply threshold value (t4) is set, this is effective to prevent image fogging due to insufficient agitation and charging, but the amount of toner that can not be properly supplied during image forming at a high printing ratio is increased. As a result, toner in the developer container is reduced, and the toner restoration sequence must be performed. Therefore, the performance of the printer would be degraded.

The maximum amount of toner that can be supplied without causing image fogging is varied depending on the operating condition of the developing apparatus, such as the durability and environment. This is because, when the environment is changed, the absolute water volume in the air differs, and accordingly, the electrostatic property of toner is changed, and because, as the number of prints is increased, the individual parts of the developing apparatus are deteriorated, and the electrostatic application capabilities relative to toner are reduced.

Therefore, in order to obtain both prevention of image fogging and prevention of shortage of toner supplied during image forming at a high printing ratio, a large value as possible in the range not to cause fogging should be set for the supply threshold value (t3). That is, the supply threshold value (t3) is corrected in accordance with the durability and environmental condition, and a large value as possible in the range so as not to cause fogging is set to the supply threshold value (t3), so that both shortage of toner supplied during high ratio printing and the image fogging can be prevented.

From these viewpoints, in order to determine the optimal amount of toner to be supplied, printing was performed, by changing the correction coefficient (α) in accordance with different environments, until the service life of the developing apparatus was reached, and the image fogging level was examined. The obtained results are shown in below in Tables 4A through 4C.

First, when the absolute water volume is the range of 5.8 [g/g (760 mmHg)] to 18.0 [g/g (760 mmHg)] for a cartridge for which the service life of the developing apparatus is defined as 40000 sheets (NN), α=0.8 should be designated up to 20000 sheets that is half of the service life of the developing apparatus, α=0.7 should be determined up to 20000 to 30000 sheets, and thereafter, α=0.6 until the service life expires. The method whereby α is changed gradually in accordance with the number of prints in this manner is the most appropriate method for correcting the supply threshold value t3, without causing image fogging and sharp reduction of the amount of toner.

When the absolute water volume is lower than 5.8 [g/g (760 mmHg)] (LL), this is the environment wherein toner is to be very easily electrified, therefore, the supply threshold value (t3) need be corrected by employing α=0.7 at the beginning of the second half of the service life of the developing apparatus (about 30000 prints).

When the absolute water volume is higher than 18.0 [g/g (760 mmHg)] (HH), toner tends to be hardly electrified because very much water is contained in air, and the supply

TABLE 4A

| | NN | 5.8 to 18.0 [g/g(760 mmHg)] Number of prints | | | | | |
|---|---|---|---|---|---|---|---|
| | α | 1-10000 | 10000-20000 | 20000-25000 | 25000-30000 | 30000-35000 | 35000-40000 |
| Correction coefficient | 1 | ○ | Δ | Δ | Δ | X | X |
| | 0.9 | ○ | Δ | Δ | Δ | X | X |
| | 0.8 | ○* | ○* | ○ | Δ | Δ | X |
| | 0.7 | ○ | ○ | ○* | ○* | Δ | Δ |
| | 0.6 | ○ | ○ | ○ | ○ | ○* | ○* |
| | 0.5 | ○ | ○ | ○ | ○ | ○ | ○ |

*Optimal maximum value

TABLE 4B

| | LL | Equal to or less than 5.8 [g/g(760 mmHg)] Number of prints | | | | | |
|---|---|---|---|---|---|---|---|
| | α | 1-10000 | 10000-20000 | 20000-25000 | 25000-30000 | 30000-35000 | 35000-40000 |
| Correction coefficient | 1 | ○ | ○ | Δ | Δ | X | X |
| | 0.9 | ○ | ○ | ○ | Δ | Δ | X |
| | 0.8 | ○* | ○* | ○* | ○* | Δ | Δ |
| | 0.7 | ○ | ○ | ○ | ○ | ○* | ○* |
| | 0.6 | ○ | ○ | ○ | ○ | ○ | ○ |
| | 0.5 | ○ | ○ | ○ | ○ | ○ | ○ |

*Optimal maximum value

TABLE 4C

| | HH | Equal to or greater than 18.0 [g/g(760 mmHg)] Number of prints | | | | | |
|---|---|---|---|---|---|---|---|
| | α | 1-10000 | 10000-20000 | 20000-25000 | 25000-30000 | 30000-35000 | 35000-40000 |
| Correction coefficient | 1 | Δ | Δ | Δ | Δ | X | X |
| | 0.9 | Δ | Δ | Δ | Δ | X | X |
| | 0.8 | ○* | Δ | Δ | Δ | Δ | X |
| | 0.7 | ○ | ○* | ○* | Δ | Δ | X |
| | 0.6 | ○ | ○ | ○ | ○* | ○* | Δ |
| | 0.5 | ○ | ○ | ○ | ○ | ○ | ○* |

*Optimal maximum value

Where:

X: level at which fogging is a problem on printed paper.

Δ: level at which fogging is not a problem on printed paper, but fogged toner is a present on a latent image bearing member.

○: level at which fogging is not a problem on printed paper.

threshold value (t3) need be corrected at the first half of the service life of the developing apparatus. $\alpha$=0.8 can be employed in the initial period of the service life; however, after 10000 sheets are printed, correction is performed, and $\alpha$=0.7 is designated. Thereafter, correction is performed step by step for every 10000 sheets, and in the second half of the service life of the developing apparatus, $\alpha$=0.5, i.e., the lower limit value of the correction coefficient is designated. Therefore, when deterioration of the individual parts has occurred through the printing operation, the amount of toner to be supplied is so adjusted that toner can be satisfactorily electrified. Thus, in the environment at a high temperature and with a high humidity and the high absolute water volume, uniform electrification of the whole toner can be easily performed.

Figure 21:
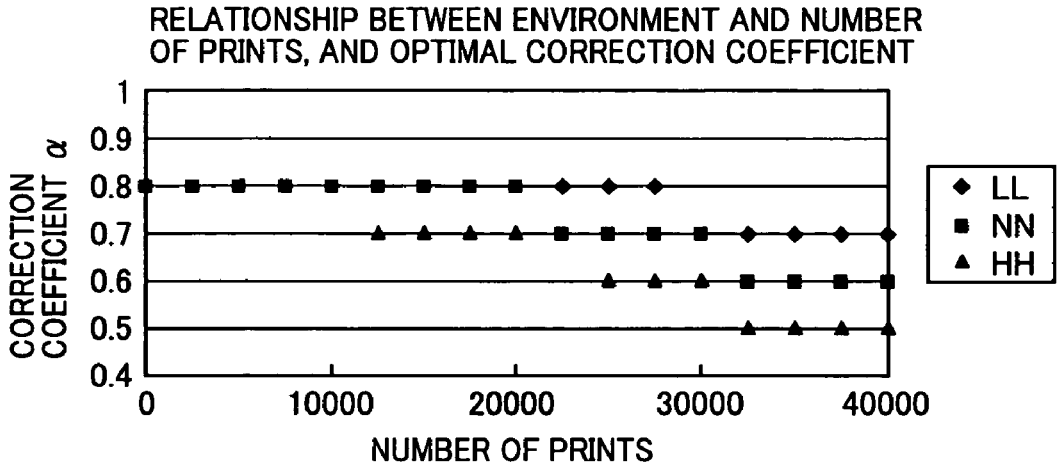
FIG. 21 is a graph showing an exemplary relationship between the optimal correction coefficient and an environment provided for, and the number of prints performed by, the image forming apparatus of the fourth embodiment.

In this manner, as shown in FIG. 21, the correction coefficient ($\alpha$) for the amount of toner to be supplied is determined in accordance with the environment and the remaining service life of the developing apparatus, and the corrected supply threshold value (t4) is optimized. As a result, a high quality image is obtained.

The durability test for printing 40000 sheets that is the service life limit of the developing apparatus was conducted by employing the configuration of this embodiment. The uneven density and image fogging due to a failure of a mixture of supplied toner did not occur, and satisfactory image forming could be maintained.

As described above, by using both the environment information and the remaining service life information for the developing apparatus, as a large value as possible in the range so as not to cause image fogging should be designated as the supply threshold value (t3). Then, in any environment, or at the end of the service life of the developing apparatus, since uniform electrification of supplied toner can be easily performed, image fogging can be prevented, and the amount of toner consumed by the developing apparatus can also be reduced. Further, the occurrence that the amount of toner in the developing apparatus is temporarily but sharply dropped can be reduced.

Therefore, it is possible to resolve both the problem that agitation and charging of toner can not be appropriately performed because a large amount of toner is added during image forming at a high printing ratio, and a request that the amount of toner in the developer container be always maintained by accurately adding the required amount of toner. Thus, the toner supply problem due to the environmental difference and the problem on insufficient electrification of toner due to the deterioration of the individual parts can be resolved. As a result, an image with a high quality can be obtained during the period until the service life of the developing apparatus expires.

In this embodiment, the correction coefficient ($\alpha$) ahs been designated based on the number of revolutions of the supply motor. However, the designation of the correction coefficient ($\alpha$) is not limited to this method. Many more levels may be designated in accordance with the function of the supply motor, or when a developing apparatus has a long service life, a larger value may be set for the correction coefficient ($\alpha$).

Further, in this embodiment, the number of prints has been employed as a way for determining the remaining service life of the developing apparatus. The service life determination method is not limited to this, and the number of rotations of the photosensitive drum may be employed.

This embodiment can also be applied for the case of employing a two-component developer that includes toner and carrier. In the case wherein the principle of the present invention is employed for the developer supply method of the developing apparatus that employs the conventional two-component developer, however, only a small amount of toner is originally present in the developing apparatus employing the two-component developer, and when refilling with toner is not immediately performed, it is predicted that the density of toner will be soon dropped, or charge-up will occur.

Therefore, it is preferable that this embodiment be used for the developing apparatus of one-component supply method because the following characteristic of the one-component developer is employed of the developer supply method for the developing apparatus. Specifically, a specific amount of toner is present in the developer container, and when toner in the developer container is temporarily reduced during image forming at a high printing ratio, refilling the container with a little delay is sufficient so long as the total amount of toner is balanced.

Fifth Exemplary Embodiment

The feature of this embodiment is that the image forming process unit, at least including a developing apparatus, is integrally formed to constitute a detachable cartridge for an image forming apparatus; a nonvolatile memory is provided as a memory unit for the cartridge; print count information, consumed toner volume information and supplied toner volume information are stored in the nonvolatile memory; and an addition value (t2), a supply threshold value (t3) and a supply correction coefficient ($\alpha$) are also stored in the nonvolatile memory.

Since the schematic configuration and the basic operation of the image forming apparatus for this embodiment are similar to those for the fourth embodiment, no further explanation will be given by quoting the explanation employed for the fourth embodiment. The cartridge that is the characteristic portion of this embodiment will now be described.

Figure 23:
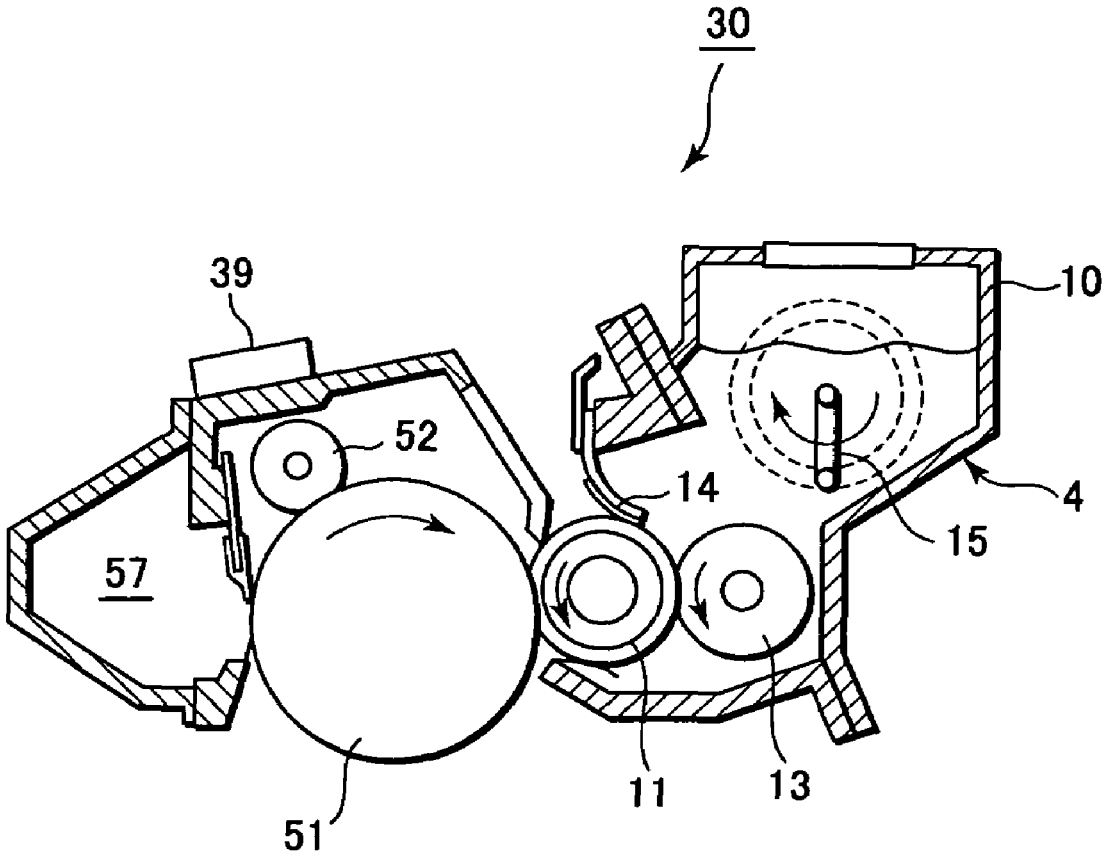
FIG. 23 is a cross-sectional view of an exemplary process cartridge employed for an image forming apparatus according to a fifth embodiment of the present invention.

The exemplary schematic structure of a cartridge employed for this embodiment is shown in FIG. 23. In this embodiment, a photosensitive drum 51 and a charging roller 52, a developing apparatus 4 and a cleaning apparatus 57 that act to the photosensitive drum 51 for image forming, all of which are similar to the fourth embodiment, are integrally formed to provide a cartridge 30 that is detachable to a main body 100A of an image forming apparatus 100. Only the developing apparatus 4 can also be provided as a cartridge that is detachable to the image forming apparatus 100. Also, for this embodiment, storage unit 39, such as a nonvolatile memory, is provided for the cartridge 30.

Figure 24:
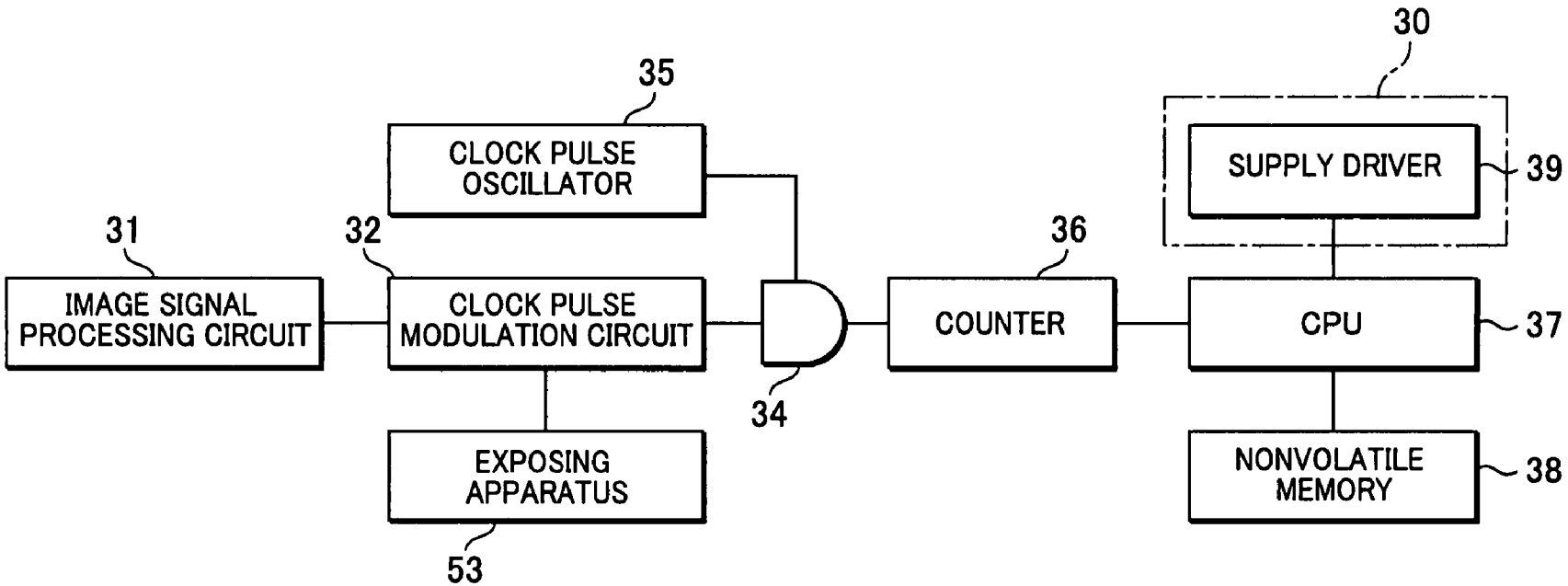
FIG. 24 is a block diagram showing an exemplary arrangement of the image forming apparatus according to the fifth embodiment.

FIG. 24 is a block diagram showing the configuration of the image forming apparatus 100 for this embodiment. The arrangement of an image signal processing section for obtaining a video count is similar to that for the fourth embodiment, i.e., similar that of the image signal processing section provided for the conventional image forming apparatus explained while referring to FIGS. 15 and 16.

The difference is the following characteristic for this embodiment. As shown in FIG. 24, before calculating an addition value t2 of the amounts of supplied toner, a CPU 37 reads an addition value t2 stored in advance in the nonvolatile memory 39 of the cartridge 30, and stores a new addition value t2 obtained by calculation in the nonvolatile memory 39 by overwriting the old value.

Figure 26:
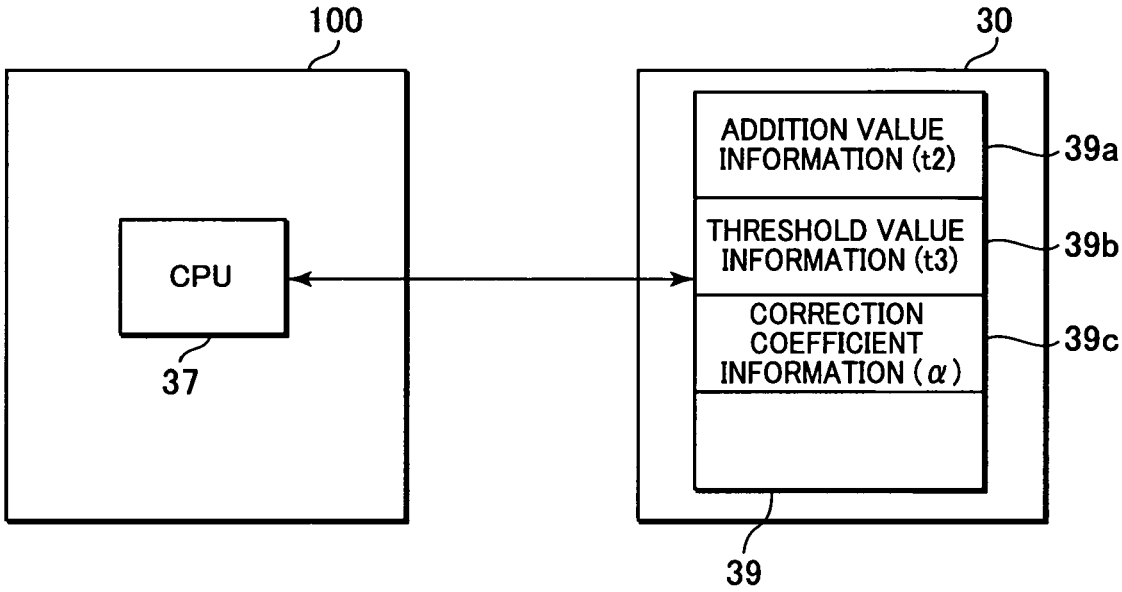
FIG. 26 is a diagram showing an exemplary storage state of a nonvolatile memory provided for the process cartridge of the fifth embodiment.

FIG. 26 is a diagram showing an exemplary storage state of the nonvolatile memory 39 of the cartridge 30. The CPU 37 of the image forming apparatus 100 performs information writing and reading relative to the nonvolatile memory 39. Storage areas are provided for the nonvolatile memory 39; in this embodiment, a storage area 39*a*, for storing a supply addition value information (t2), a storage area 39*b*, for storing supply threshold value information (t3), and a storage area 39*c*, for storing correction coefficient information (α).

Figure 25:
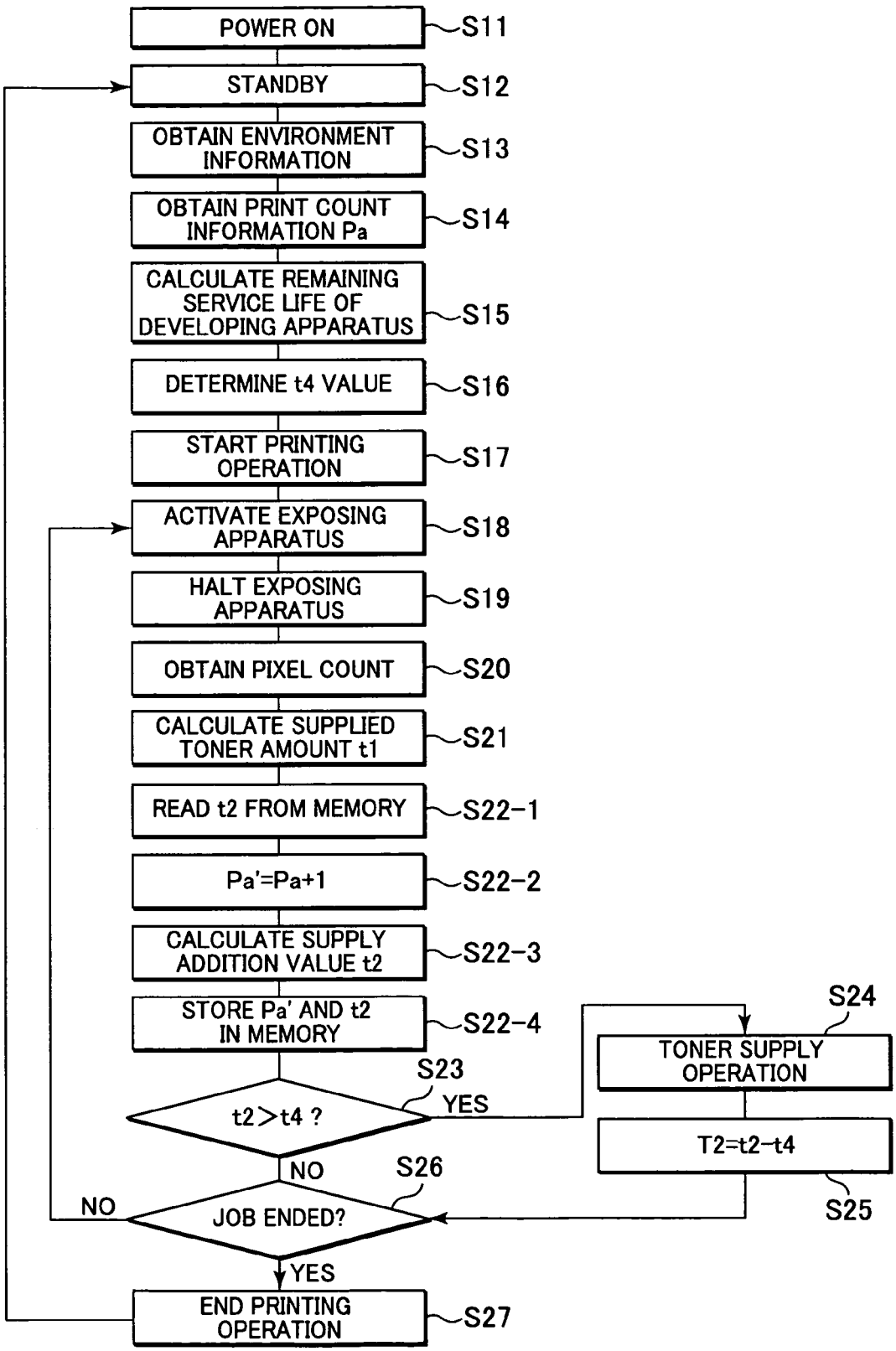
FIG. 25 is a flowchart for an exemplary operation of the image forming apparatus of the fifth embodiment.

FIG. 25 is a flowchart showing exemplary processing for this embodiment. This processing is similar to that explained while referring to the flowchart for the fourth embodiment except for the following difference. In the fourth embodiment, at steps S21 and S22, the CPU 37, which controls the operation of the image forming apparatus 100, employs a video count value to calculate, for each image forming process, the amount of toner to be supplied t1 (S21 and S22), and then, compares the supply addition value t2 with the corrected supply threshold value t4 (S23).

As shown in FIG. 25, the processing includes steps S17 and S22-1 to S22-4, and as well as in the fourth embodiment, the CPU 37 employs the video count value to calculate, for each image forming process, the amount of toner to be supplied t1 (S21). Following this, before calculating the addition value t2 for the amount of supplied toner, the CPU 37 reads the addition value t2 that is stored in the nonvolatile memory 39 of the cartridge 30 and that is the sum of the amounts of toner supplied up to the previous image forming process (S22-1). Then, the CPU 37 updates the print count Pa to Pa' (S22-2), and calculates a new supply addition value t2 (S22-3). Sequentially, the CPU 37 compares the latest supply addition value t2 with the supply threshold value t4 that has been corrected by employing the correction coefficient (α) stored in the nonvolatile memory 39 (S23). The new addition value t2 and the updated print count Pa' are stored in the nonvolatile memory 39 of the cartridge 30 by overwriting the old values (S22-4).

Figure 20:
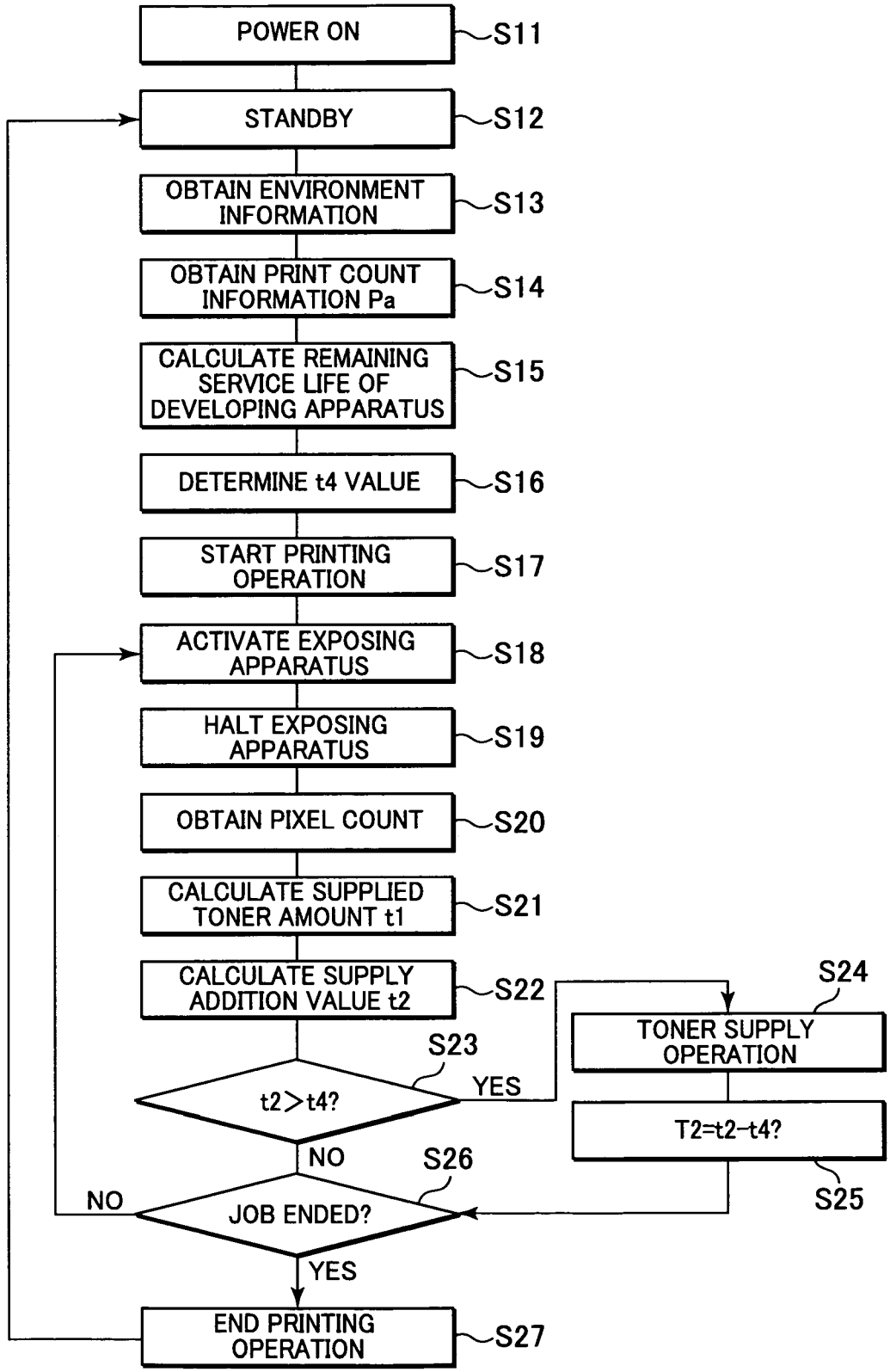
FIG. 20 is a flowchart for an exemplary operation of the image forming apparatus of the fourth embodiment.

Except for steps S22-1 to S22-4, the toner supply operation in the flowchart in FIG. 25 for this embodiment is similar to the toner supply operation explained for the fourth embodiment, while referring to the flowchart in FIG. 20. Thus, the same step numbers are provided for the same processes, and no further explanation will be given by quoting the explanation employed for the fourth embodiment.

According to this embodiment, similar operating effects as obtained in the fourth embodiment can be acquired. Further, with the above described configuration, the addition value t2 that is the supplied toner volume information, the print count information, the consumed toner volume information are always stored in the nonvolatile memory 39 provided for the developer container. Assume that the developing apparatus is removed from the image forming apparatus while image forming at a high printing ratio is currently performed and a large addition value is stored. Since the amount of toner to be added is stored in the nonvolatile memory of the developer container, when the developing apparatus is mounted again to the image forming apparatus, refilling with toner can be performed to resolve the temporary shortage of toner. Thus, reduction of toner in the developer container or malfunctioning of the developer container can be prevented.

Therefore, the supply control operation explained in the fourth embodiment can also be performed appropriately when the developing apparatus is detached from the image forming apparatus.

Furthermore, when a cartridge form is employed, the parts can be easily exchanged, and the maintenance of the image forming apparatus is improved. In addition, by exchanging the cartridges, the important electrophotographic components are replaced with new ones, so that images with a high quality can be always maintained.

In addition, in this embodiment, the inherent supply threshold value t3 and the unique correction coefficient α can be provided for different cartridges, such as a red cartridge and a black cartridge, wherein different color developers are held. In this case, the same operating effects as obtained in the fourth embodiment can be acquired, and also the optimal supply threshold value t3 and the optimal correction coefficient α can be separately provided in accordance with the manufacturing condition. Thus, the image forming apparatus can be always operated based on the optimal supply threshold value.

Sixth Exemplary Embodiment

The feature of this embodiment is that an image forming apparatus where a plurality of process cartridges are mounted performs an operation as explained in the fifth embodiment, and that a supply threshold value (t3) and a supply correction coefficient (α) is stored in the nonvolatile memories of the process cartridges. Further, as well as in the fifth embodiment, print count information, consumed toner volume information and supplied toner volume information can also be stored in the nonvolatile memories.

Figure 27:
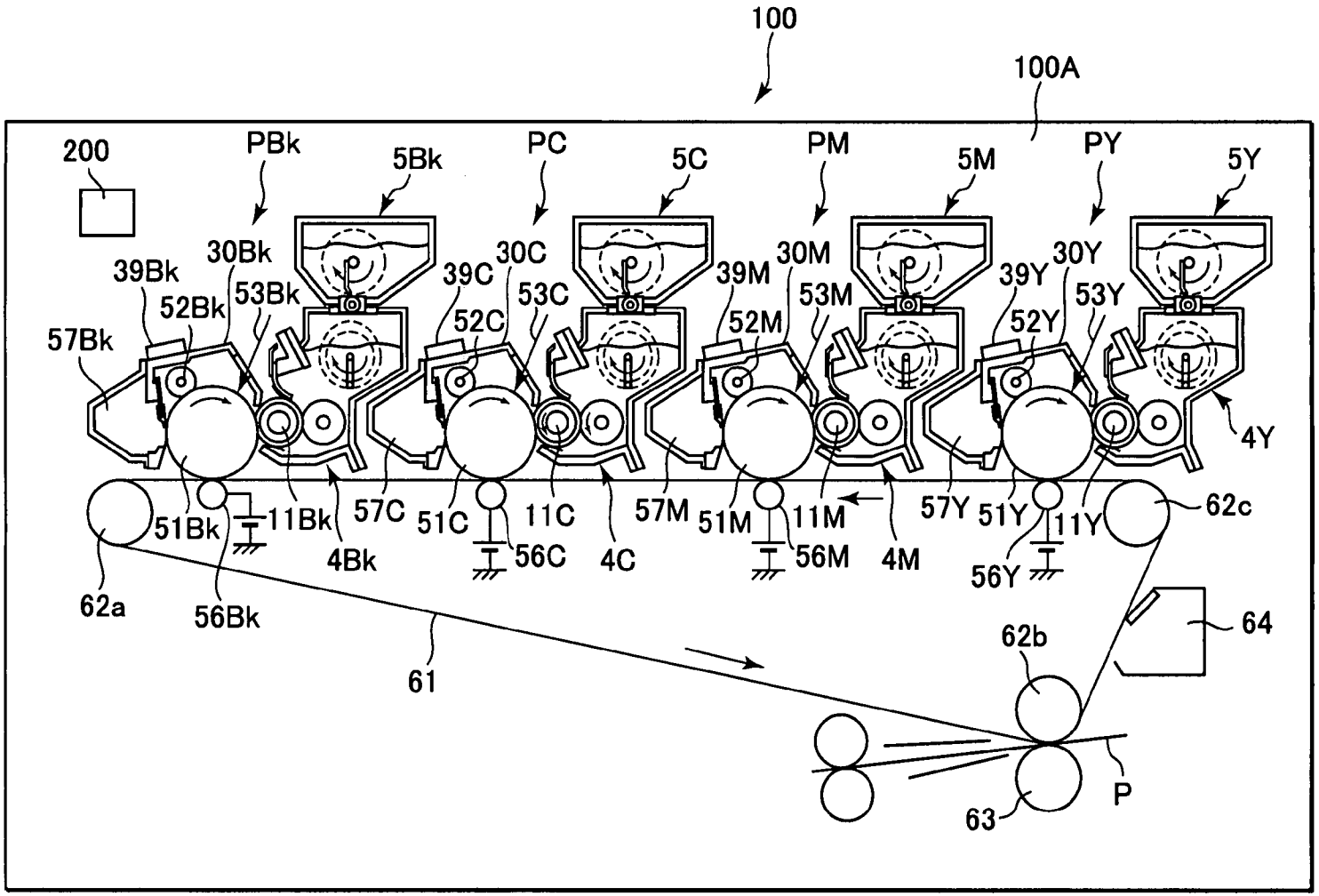
FIG. 27 is a schematic cross-sectional view of an exemplary configuration of an image forming apparatus according to a sixth embodiment of the present invention.

FIG. 27 is a diagram showing an example color image forming apparatus of tandem intermediate transferring type according to the embodiment. In this embodiment, in a main body 100A of an image forming apparatus 100, four image forming sections, i.e., image forming stations P (PY, PM, PC and PBk) are arranged in series in the image feeding direction. The individual image forming stations P (PY, PM, PC and PBk) include, respectively, electro-photographic photosensitive members in a drum shape, i.e., photosensitive drums 51 (51Y, 51M, 51C and 51Bk), which are image bearing members; electrifiers 52 (52Y, 52M, 52C and 52Bk), which are charging rollers serving as a charging unit; exposing apparatuses 53 (53Y, 53M, 53C and 53Bk), which are laser beam scanner units serving as an exposure unit; developing apparatuses 4 (4Y, 4M, 4C and 4Bk), which serve as a developing unit; cleaning apparatuses 57 (57Y, 57M, 57C and 57Bk), which serve as a cleaning unit and include a cleaning blade; and primary transferring apparatuses 56 (56Y, 56M, 56C and 56Bk), which are transferring rollers serving as a primary transferring unit.

The photosensitive drums 51 (51Y, 51M, 51C and 51Bk), the electrifiers 52 (52Y, 52M, 52C and 52Bk), the developing apparatuses 4 (4Y, 4M, 4C and 4Bk) and the cleaning apparatuses 57 (57Y, 57M, 57C and 57Bk), which constitute the respective image forming stations P (PY, PM, PC and PBk), are formed integrally to provide cartridges 30 (30Y, 30M, 30C and 30Bk). The cartridges 30 in this embodiment have a similar structure as that for the cartridge 30 explained for the fifth embodiment while referring to FIG. 23.

Supply apparatuses 5 (5Y, 5M, 5C and 5Bk), which is similar to the supply device 5 used in the fourth embodiment, are arranged in the image forming apparatus 100 to be replaceable. The structures and the operations of the components, such as the photosensitive drums 51, the developing apparatuses 4 and the electrifiers 52, of the cartridges 30 are similar to those for the fourth and the fifth embodiments, the same reference numerals are employed to denote members that have the same structure and functions as the cartridge 30 and the toner supply apparatus 5 in the fourth and fifth embodiments, and no further explanation for them will be given by quoting the description provided for the fourth and fifth embodiments.

Furthermore, the arrangement of the image signal processing section for obtaining a video count is the similar to that explained for the fourth embodiment, i.e., the image signal processing section of the conventional image forming apparatus explained while referring to FIGS. 15 and 16, and the configuration explained for the fifth embodiment while referring to FIG. 24. Therefore, the explanation employed for the fourth and fifth embodiments is quoted and no further explanation will be given.

In the image forming apparatus 100 for this embodiment, an intermediate transferring belt 61, which is an intermediate transferring member in a belt shape, is extended between support rollers 62*a*, 62*b* and 62*c* and through the gaps between the photosensitive drums 51 (51Y, 51M, 51C and 51Bk) and the primary transferring apparatuses 56 (56Y, 56M, 56C and 56Bk) of the image forming stations P (PY, PM, PC and PBk), and can travel in a direction indicated by arrows.

In this embodiment, light sources and polygon mirrors that constitute exposing apparatuses 53 are also arranged above the main body 100A, and in consonance with image signals, electrostatic latent images are formed on the photosensitive drums 51 (51Y, 51M, 51C and 51Bk).

Predetermined amounts of one-component developers that are non-magnetic yellow, magenta, cyan and black toners are filled in the developing apparatuses 4 (4Y, 4M, 4C and 4Bk). By developing rollers 11 (11Y, 11M, 11C and 11Bk), the latent images on the photosensitive drums 51 are developed using toner of different colors to form toner images, and the toner images are transferred to the intermediate transferring belt 61.

Further, a transferring material P stored in a transferring material cassette (not shown) is conveyed to a secondary transferring roller 63, which serves as a secondary transferring apparatus that is a secondary transferring unit, and the toner images carried on the intermediate transferring belt 61 are transferred to the transferring material P. The toner images are fixed to the transferring material P by a fixing apparatus (not shown) using heat and pressure, and the transferring material P with the thus obtained full color image is discharged outside the image forming apparatus 100.

An intermediate transferring belt cleaning apparatus 64 is located downstream from the position for secondary transfer to the transferring material P in the direction in which the intermediate transferring belt 61 travels. Fogged toner attached to the surface of the intermediate transferring belt 61 and the secondary transferring residual toner are removed by this cleaning apparatus 64.

The toner remaining on the photosensitive drums 51 (51Y, 51M, 51C and 51Bk) after the primary transfer process is removed by the photosensitive drum cleaning apparatuses 57 (57Y, 57M, 57C and 57Bk).

For such a full color image forming apparatus, since images of multiple colors are superimposed on a single sheet, a much higher image fogging level than that for the monochrome model is requested. The toner supply method in this embodiment can be employed appropriately also for the full color image forming apparatus.

Especially, since the supply threshold value t3 and the correction coefficient α are stored in the nonvolatile memories 39 (37Y, 39M, 39C and 39Bk) of the process cartridges 30 (30Y, 30M, 30C and 30Bk), inherent supply threshold values t3 and correction coefficients α can be provided for the individual developing apparatus.

Therefore, the same operating effects as obtained in the fourth and fifth embodiments can also be acquired in this embodiment, and especially, the optimal supply threshold value t3 and the optimal correction coefficient α can be separately provided in accordance with the cartridge manufacturing condition, or different supply threshold values t3 and correction coefficients α can be provided for different colors of toner. Thus, the image forming apparatus can be always operated in accordance with the optimal supply threshold value.

In the above described embodiments, the amount of consumed developer has been calculated based on the printing ratio. The calculation method is not limited to this, and, for example, a method for providing an electrode, such as an antenna, for a developer container to detect the electrostatic capacity and for calculating the amount of a consumed developer, or a method for detecting the load imposed on an agitation member to calculate the amount of a consumed developer can be employed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2005-146448 and Japanese Patent Laid-Open No. 2005-146476, filed May 19, 2005, which are hereby incorporated by reference herein in its entirety.

What is claimed:

1. An image forming apparatus comprising:

a developing apparatus configured to form a developer image;

a supply apparatus configured to supply developer to the developing apparatus;

a detector configured to detect an amount of developer consumed during an image forming process; and a controller configured to perform an addition calculation for the amount of developer consumed, and for employing a value obtained by the addition calculation and a supply threshold value to determine whether developer should be supplied to the developing apparatus, wherein the controller sets the supply threshold value in accordance with an operating state of the developing apparatus and a remaining life of the developing apparatus.

2. The image forming apparatus according to claim 1, wherein when the value obtained by the addition calculation is greater than the supply threshold value, the supply apparatus replenishes the developing apparatus with an amount of the developer equivalent to the supply threshold value.

3. The image forming apparatus according to claim 1, further comprising a temperature/humidity detector, wherein the controller employs detection results obtained by the temperature/humidity detector to designate the supply threshold value.

4. The image forming apparatus according to claim 1, wherein the detector employs a printing ratio to detect the amount of the developer consumed during the image forming process.

5. The image forming apparatus according to claim 1, the remaining life of the developing apparatus is obtained from a limit number of prints for a life of the developing device and a current print count.

6. A detachable cartridge configured to be utilized in an image forming apparatus that includes a supply apparatus for supplying developer to a developing apparatus, and a detector for detecting an amount of developer consumed during an image forming process, the cartridge comprising:

a developing apparatus configured to hold developer; and a storage device configured to store information, wherein the storage device includes, a first storage area configured to store information related to a value obtained by performing an addition calculation for the amount of developer consumed;

a second storage area configured to store information related to a supply threshold value used for controlling an operation performed by the supply apparatus; and a third storage area configured to store information used to correct the supply threshold value, wherein the information used to correct the supply threshold value is a correction coefficient to be determined in accordance with an operating state of the developing apparatus and a remaining life of the developing apparatus.

7. A cartridge according to claim 5, further comprising an image bearing member on which an image is to be formed.

8. A storage device adapted to be mounted on a cartridge used in an image forming apparatus that includes a supply apparatus for supplying developer to a developing apparatus, and a detector for detecting an amount of developer consumed during an image forming process, the storage device comprising:

a first storage area configured to store information related to a value obtained through an addition calculation performed for the amount of developer consumed;

a second storage area configured to store information related to a supply threshold value used to control an operation performed by the supply apparatus; and a third storage area configured to store information for correcting the supply threshold value, wherein the information for correcting the supply threshold value is a correction coefficient to be determined in accordance with an operating state of the developing apparatus and a remaining life of the developing apparatus.

* * * * *